US011413872B2

(12) United States Patent
Maruta

(10) Patent No.: US 11,413,872 B2
(45) Date of Patent: Aug. 16, 2022

(54) INKJET RECORDING APPARATUS FOR RECORDING IMAGES BY EJECTING INK ON RECORDING MEDIA

(71) Applicant: KYOCERA Document Solutions Inc., Osaka (JP)

(72) Inventor: Masaaki Maruta, Osaka (JP)

(73) Assignee: KYOCERA Document Solutions Inc., Osaka (JP)

( * ) Notice: Subject to any disclaimer, the term of this patent is extended or adjusted under 35 U.S.C. 154(b) by 0 days.

(21) Appl. No.: 17/067,707

(22) Filed: Oct. 11, 2020

(65) Prior Publication Data

US 2021/0107284 A1 Apr. 15, 2021

(30) Foreign Application Priority Data

Oct. 11, 2019 (JP) ..... JP2019-188142

(51) Int. Cl.
*B41J 2/165* (2006.01)
*B41J 11/00* (2006.01)

(52) U.S. Cl.
CPC ..... *B41J 2/16517* (2013.01); *B41J 2/1652* (2013.01); *B41J 11/007* (2013.01)

(58) Field of Classification Search
CPC ..... B41J 2/16517; B41J 2/1652; B41J 11/007
See application file for complete search history.

(56) References Cited

U.S. PATENT DOCUMENTS 8,382,241 B2 * 2/2013 Saitoh ..... B41J 2/16526 347/35
2006/0023049 A1 2/2006 Koike et al.
2011/0063353 A1 3/2011 Takeuchi et al.

FOREIGN PATENT DOCUMENTS

JP 2004216758 A * 8/2004
JP 2004291483 A * 10/2004 ..... B41J 2/16526
JP 2005125593 A * 5/2005
JP 2006-021399 A 1/2006
JP 2008-179167 A 8/2008
JP 2011-079293 A 4/2011
JP 2011-189717 A 9/2011
JP 2012024928 A * 2/2012

* cited by examiner

*Primary Examiner* — Sharon Polk
(74) *Attorney, Agent, or Firm* — Hawaii Patent Services; Nathaniel K. Fedde; Kenton N. Fedde

(57) ABSTRACT

Provided is an inkjet recording apparatus that reduces excessive or insufficient flushing of each of the nozzles by appropriately controlling the ink ejection amount in the next flushing for each nozzle based on the actual ink ejection state of each of the nozzles of a recording head during image formation. A control unit causes the recording head to execute flushing for ejecting the ink at a timing different from a timing that contributes to image formation on the recording medium. A conveyor belt has opening portions for allowing ink ejected from each of the nozzles of the recording head during flushing to pass. The control unit controls the ink ejection amount for each of the nozzles during the next flushing based on an integrated printing rate for each of the nozzles after the recording head has performed the previous flushing.

15 Claims, 21 Drawing Sheets

| | INK EJECTION AMOUNT (pl) DURING PREVIOUS FLUSHING | INTEGRATED PRINTING RATE | INK EJECTION AMOUNT (pl) DURING NEXT FLUSHING |
|---|---|---|---|
| FIRST INK EJECTION PORT | A1 | 10% | A2(>A1) |
| SECOND INK EJECTION PORT | A1 | 50% | A1 |
| ⋮ | ⋮ | ⋮ | ⋮ |
| NTH INK EJECTION PORT | A1 | 80% | A3(<A1) |

FIG.19

| ENVIRONMENTAL TEMPERATURE | LOW TEMPERATURE (LESS THAN FIRST THRESHOLD VALUE) | HIGH TEMPERATURE (EQUAL TO OR GREATER THAN FIRST THRESHOLD VALUE) |
|---|---|---|
| INK EJECTION AMOUNT (pl) DURING FLUSHING | A2 | A21(<A2) |

FIG.20

| RECORDING HEAD TEMPERATURE | LOW TEMPERATURE (LESS THAN SECOND THRESHOLD VALUE) | HIGH TEMPERATURE (EQUAL TO OR GREATER THAN SECOND THRESHOLD VALUE) |
|---|---|---|
| INK EJECTION AMOUNT (pl) DURING FLUSHING | A2 | A22(<A2) |

FIG.21

| INK TYPE (COLOR) | Y | M | C | K |
|---|---|---|---|---|
| INK EJECTION AMOUNT (pl) DURING FLUSHING | A2 | A23 | A24 | A25 |

FIG.22

| PAPER SIZE | A4 (HORIZONTAL)/ LETTER (HORIZONTAL) | A4 (VERTICAL)/ LETTER (VERTICAL) | A3/B4/Legal | 13 × 19.2 |
|---|---|---|---|---|
| INK EJECTION AMOUNT(pl) DURING FLUSHING | A2 | A26(>A2) | A2 | A26(>A26) |

FIG.23

INKJET RECORDING APPARATUS FOR RECORDING IMAGES BY EJECTING INK ON RECORDING MEDIA

INCORPORATION BY REFERENCE

This application is based on and claims the benefit of priority from Japanese Patent Application No. 2019-188142 filed on Oct. 11, 2019, the contents of which are hereby incorporated by reference.

BACKGROUND

The present disclosure relates to an inkjet recording apparatus that records an image by ejecting ink onto a recording medium.

Conventionally, in an inkjet recording apparatus such as an inkjet printer and the like, flushing (idle ejection) for ejecting ink from the nozzles is regularly performed in order to reduce or prevent clogging of the nozzles due to drying of the ink. For example, in an inkjet recording apparatus of a typical technique, an opening portion is provided in a conveyor belt, and a recording medium is placed on the conveyor belt so as not to cover the opening portion and conveyed. Then, when the opening portion reaches a position facing the recording head due to the running of the conveyor belt, ink is ejected from the nozzles of the recording head to perform flushing. An ink absorber such as a sponge or the like is arranged on the side opposite to the recording head (inner peripheral surface side) with respect to the conveyor belt. Ink that is ejected from the recording head and passed through the opening portion during flushing is absorbed by the ink absorber.

Moreover, for example, in an inkjet recording apparatus of a typical technique, a plurality of opening portions are provided in the conveyor belt in the conveying direction of the recording medium, and in a case where the size of the recording medium is large, the conveying speed of the recording medium is slowed to perform flushing. By decreasing the conveying speed of the recording medium, the number of rows in the conveying direction of the opening portions located between the recording media on the conveyor belt increases, so ejection defects may be reduced by increasing the ink ejection amount required for flushing. Furthermore, in another typical technique, the position of the opening portions is recognized based on the detection result of a mark provided on the conveyor belt, and the ejection of ink in flushing is controlled. Whereby, to take into account deformation such as elongation of the conveyor belt and the like, ink is more accurately passed through the opening portions.

SUMMARY

In order to accomplish the object described above, an inkjet recording apparatus according to one aspect of the present disclosure includes a recording head and a continuous conveyor belt. The recording head has a plurality of nozzles that eject ink. The continuous conveyor belt conveys a recording medium to a position facing the recording head. In addition, the inkjet recoding apparatus further includes a control unit that causes the recording head to execute flushing for ejecting the ink at a timing different from a timing that contributes to image formation on the recording medium. The conveyor belt has opening portions for allowing the ink ejected from each nozzle of the recording head at the time of the flushing to pass. The control unit controls an ink ejection amount in a next flushing for each of the nozzles based on an integrated printing rate for each of the nozzles after the recording head performs a previous flushing.

BRIEF DESCRIPTION OF THE DRAWINGS

FIG. 19 is an explanatory diagram illustrating an example of setting the flushing amount at each of the ink ejection ports.

FIG. 20 is an explanatory diagram illustrating an example of setting the flushing amount according to the usage environment.

FIG. 21 is an explanatory diagram illustrating an example of setting the flushing amount according to the temperature of the recording head of the recording unit.

FIG. 22 is an explanatory diagram illustrating an example of setting the flushing amount according to the type of ink.

FIG. 23 is an explanatory diagram illustrating an example of setting the flushing amount according to the paper size.

DETAILED DESCRIPTION

[1. Configuration of an Inkjet Recording Apparatus]

Figure 1:
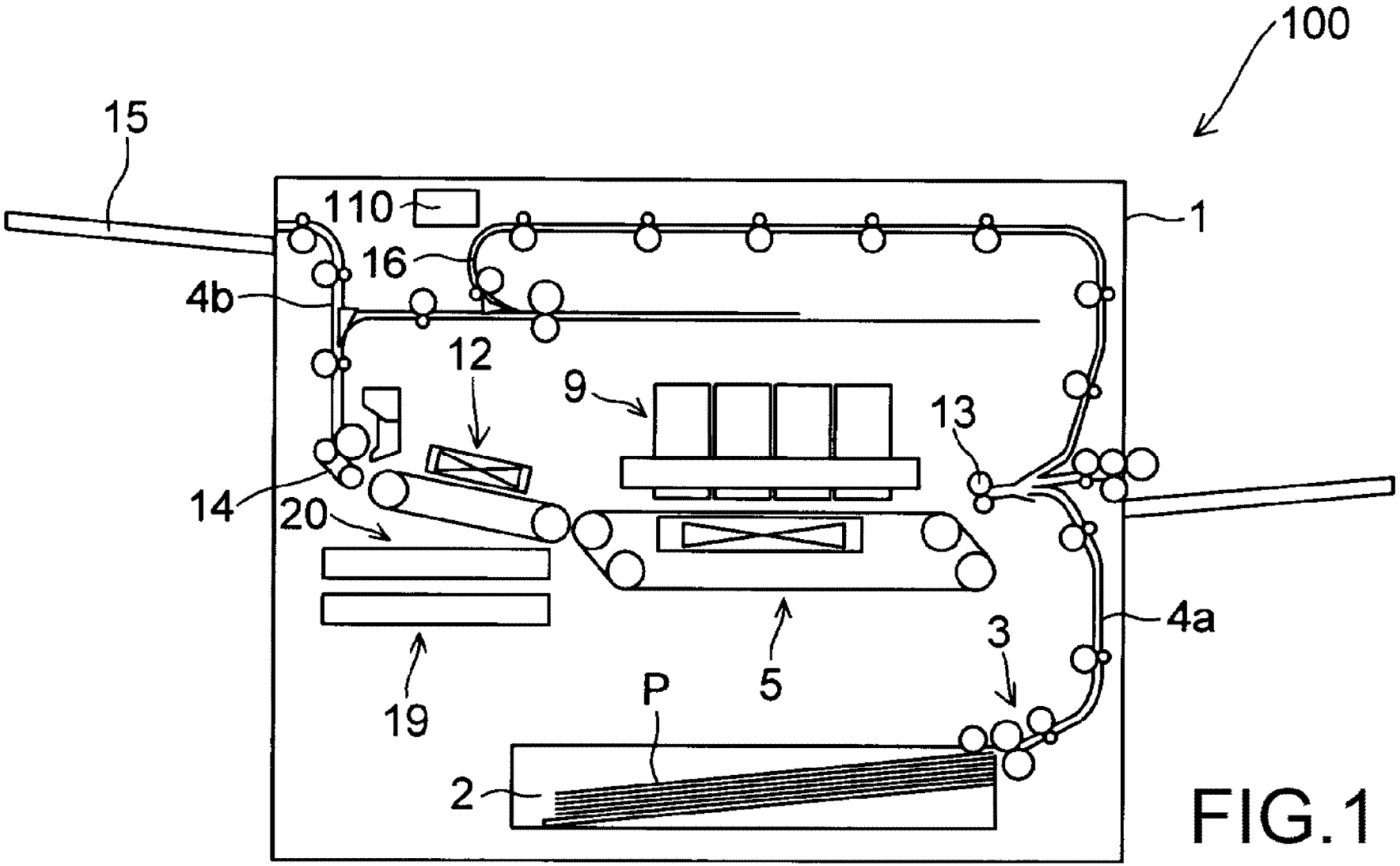
FIG. 1 is an explanatory diagram illustrating a schematic configuration of a printer as an inkjet recording apparatus according to an embodiment of the present disclosure.

Hereinafter, embodiments of the present disclosure will be described with reference to the drawings. FIG. 1 is an explanatory diagram illustrating a schematic configuration of a printer 100 as an inkjet recording apparatus according to an embodiment of the present disclosure. The printer 100 includes a paper feed cassette 2 that is a paper storage unit. The paper feed cassette 2 is arranged at the lower inner portion of the printer body 1. Paper P, which is an example of a recording medium, is housed inside the paper feed cassette 2.

A paper feeding device 3 is arranged on the downstream side in the paper conveying direction of the paper feed cassette 2, or in other words, above the right side of the paper feed cassette 2 in FIG. 1. By this paper feeding device 3, paper P is directed toward the upper right of the paper feed cassette 2 in FIG. 1, and is separated and fed out one sheet at a time.

The printer 100 includes a first paper conveying path 4*a* in the inner portion thereof. The first paper conveying path 4*a* is located on the upper right side, which is the paper feed direction, with respect to the paper feed cassette 2. The paper P fed out from the paper feed cassette 2 is conveyed vertically upward along the side surface of the printer body 1 by the first paper conveying path 4*a*.

A registration roller pair 13 is provided at the downstream end of the first paper conveying path 4*a* in the paper conveying direction. Furthermore, a first conveying unit 5 and the recording unit 9 are arranged immediately downstream of the registration roller pair 13 in the paper conveying direction. The paper P fed out from the paper feed cassette 2 reaches the registration roller pair 13 via the first paper conveying path 4*a*. The registration roller pair 13 feeds the paper P toward the first conveying unit 5 while correcting diagonal feeding of the paper P and measuring the timing with the ink ejection operation performed by the recording unit 9.

The paper P fed to the first conveying unit 5 is conveyed to a position facing the recording unit 9 (especially recording heads 17*a* to 17*c* described later) by the first conveyor belt 8 (see FIG. 2). An image is recorded on the paper P by ejecting ink from the recording unit 9 onto the paper P. At this time, the ejection of ink in the recording unit 9 is controlled by the control unit 110 in the inner portion of the printer 100. The control unit 110 includes, for example, a central processing unit (CPU).

The second conveying unit 12 is arranged on the downstream side (left side in FIG. 1) of the first conveying unit 5 in the paper conveying direction. The paper P on which the image is recorded by the recording unit 9 is sent to the second conveying unit 12. The ink ejected onto the surface of the paper P is dried while passing through the second conveying unit 12.

A decurler unit 14 is provided on the downstream side of the second conveying unit 12 in the paper conveying direction and near the left side surface of the printer body 1. The paper P whose ink has been dried by the second conveying unit 12 is sent to the decurler unit 14 in order to correct curling that has occurred in the paper P.

A second paper conveying path 4*b* is provided on the downstream side (upper side in FIG. 1) of the decurler unit 14 in the paper conveying direction. In a case where double-sided recording is not performed, paper P that has passed through the decurler unit 14 passes through the second paper conveying path 4*b* and is discharged to the paper discharge tray 15 provided in the outer portion of the left side surface of the printer 100.

A reverse conveying path 16 for performing double-sided recording is provided in the upper portion of the printer body 1 above the recording unit 9 and the second conveying unit 12. In a case of performing double-sided recording, the paper P that has passed through the second conveying unit 12 and the decurler unit 14 after recording on one surface (first surface) of the paper P is sent to the reverse conveying path 16 through the second paper conveying path 4*b*.

The conveying direction of the paper P sent to the reverse conveying path 16 is subsequently switched for recording on the other surface (second surface) of the paper P. Then, the paper P passes through the upper portion of the printer body 1 and is sent toward the right side, and is sent again, via the registration roller pair 13, to the first conveying unit 5 with the second surface thereof facing upward. In the first conveying unit 5, the paper P is conveyed to a position facing the recording unit 9, and an image is recorded on the second surface by ejecting ink from the recording unit 9. The paper P after double-sided recording is discharged to the paper discharge tray 15 via the second conveying unit 12, the decurler unit 14, and the second paper conveying path 4*b* in this order.

Moreover, a maintenance unit 19 and a cap unit 20 are arranged below the second conveying unit 12. When executing purging, the maintenance unit 19 moves horizontally below the recording unit 9, wipes the ink extruded from the ink ejection port of the recording head, and collects the wiped ink. Note that purging refers to an operation of forcibly extruding the ink from the ink ejection port of the recording head in order to discharge thickened ink, foreign matter and air bubbles in the ink ejection port. The cap unit 20 moves horizontally below the recording unit 9 when capping the ink ejection surface of the recording head, moves further upward, and is attached to the lower surface of the recording head.

Figure 2:
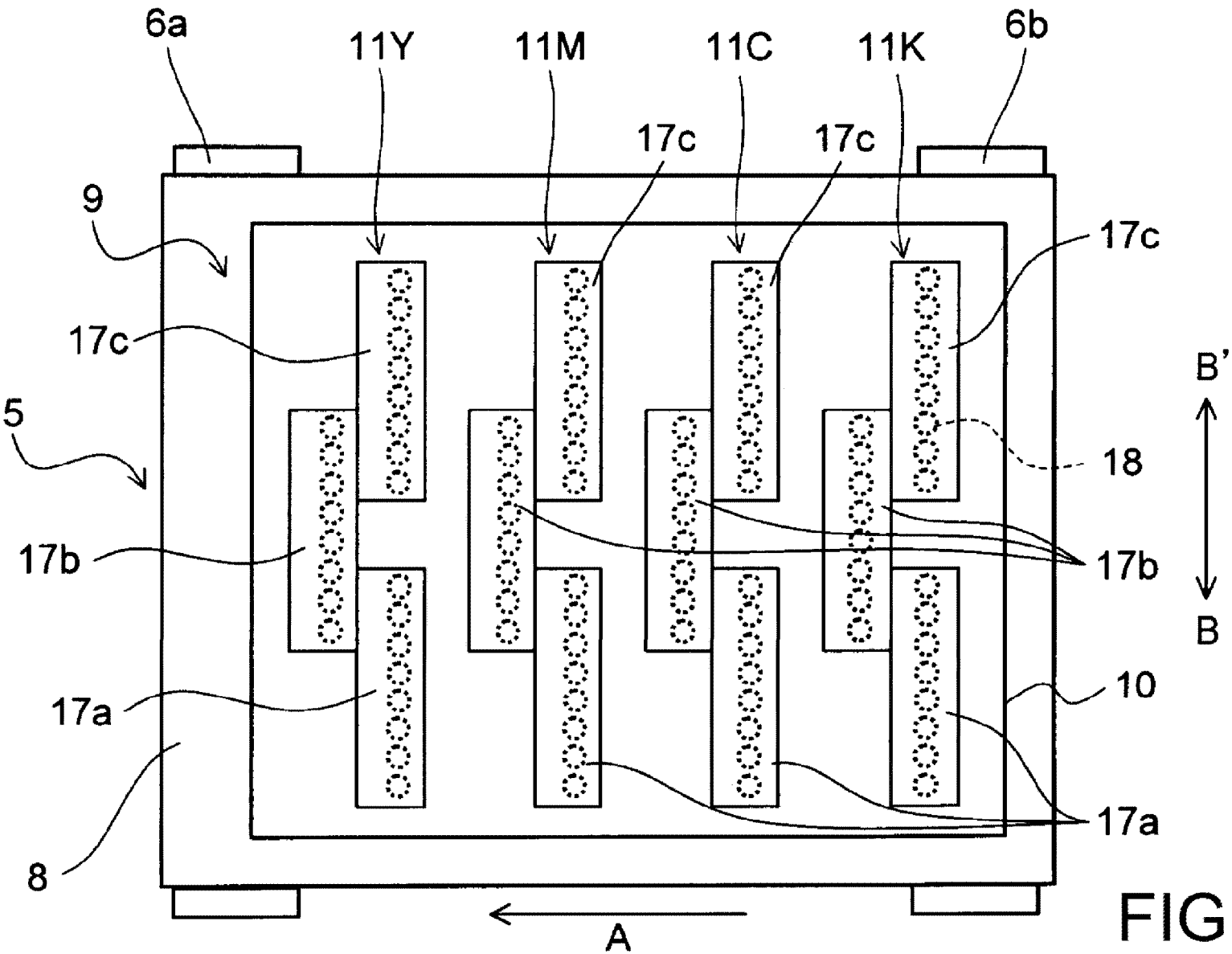
FIG. 2 is a plan view of a recording unit included in the printer.

FIG. 2 is a plan view of the recording unit 9. The recording unit 9 includes a head housing 10 and line heads 11Y, 11M, 11C and 11K. The line heads 11Y to 11K are held in the head housing 10 at a height at which specific spacing (for example, 1 mm) is formed with respect to the conveying surface of an endless first conveyor belt 8 that spans around a plurality of rollers including a drive roller 6*a*, a follower roller 6*b*, and another roller 7.

The line heads 11Y to 11K have a plurality of (here, three) recording heads 17*a* to 17*c*, respectively. The recording heads 17*a* to 17*c* are arranged in a zigzag pattern along the paper width direction (direction of arrow BB') orthogonal to the paper conveying direction (direction of arrow A). The recording heads 17*a* to 17*c* have a plurality of ink ejection ports 18 (nozzles). The each ink ejection ports 18 are arranged side by side at equal intervals in the width direction of the recording head, or in other words, the paper width direction (direction of arrow BB'). From the line heads 11Y to 11K, ink of each color of yellow (Y), magenta (M), cyan (C), and black (K) is respectively ejected via the ink ejection ports 18 of the recording heads 17*a* to 17*c* toward the paper P that is conveyed by the first conveyor belt 8.

Figure 3:
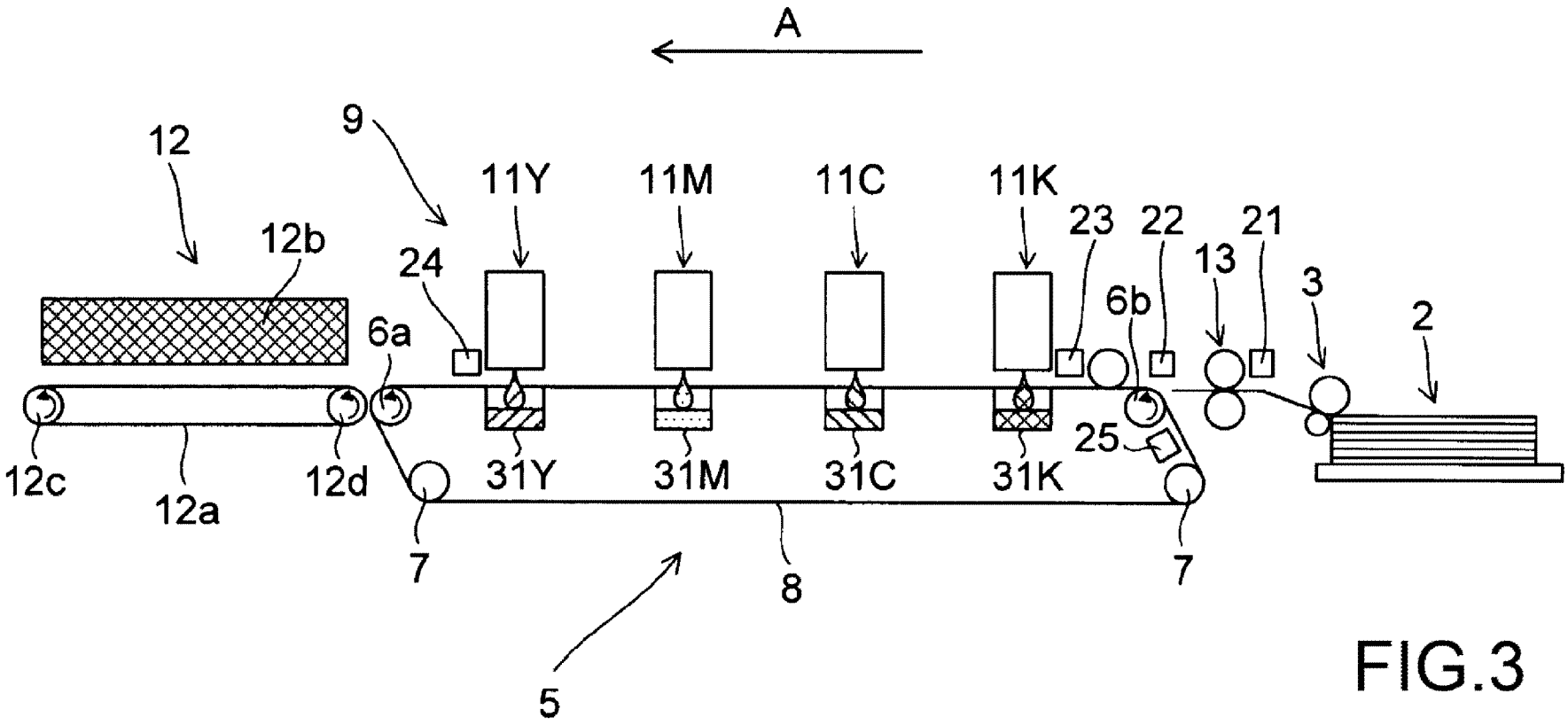
FIG. 3 is an explanatory diagram schematically illustrating the configuration around the paper conveying path from the paper feed cassette of the printer to a second conveying unit via a first conveying unit.
Figure 4:
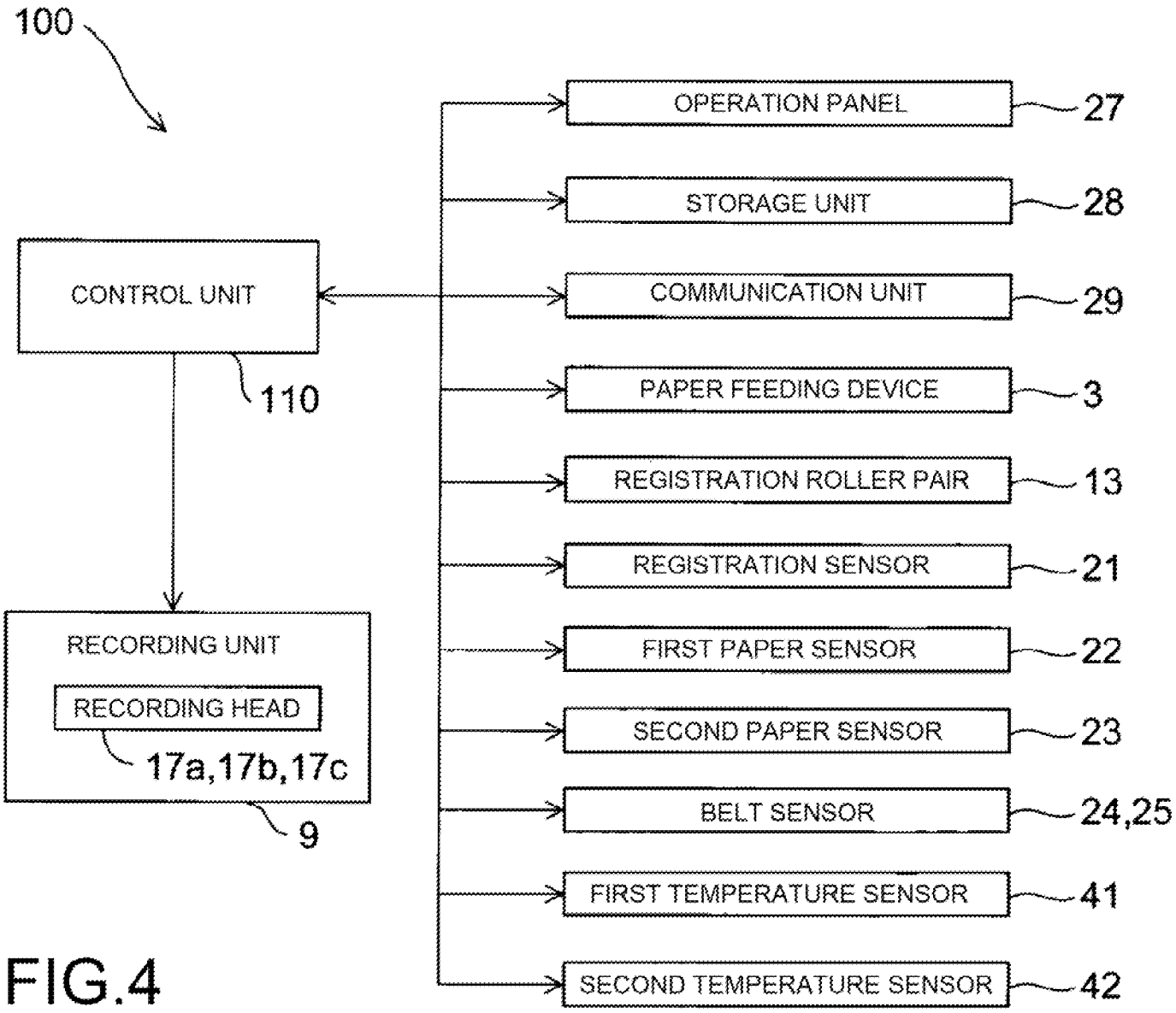
FIG. 4 is a block diagram illustrating a hardware configuration of a main part of the printer.

FIG. 3 schematically illustrates the configuration around the conveying path of the paper P from the paper feed cassette 2 to the second conveying unit 12 via the first conveying unit 5. Moreover, FIG. 4 is a block diagram illustrating a hardware configuration of a main part of the printer 100. The printer 100, in addition to the configuration described above, further includes a registration sensor 21, a first paper sensor 22, a second paper sensor 23, belt sensors 24 and 25, first temperature sensor 41, and second temperature sensor 42.

The registration sensor 21 detects the paper P conveyed from the paper feed cassette 2 by the paper feeding device 3 and sent to the registration roller pair 13. The control unit 110 is able to control the rotation start timing of the registration roller pair 13 based on the detection result of the registration sensor 21. For example, the control unit 110 is able to control the supply timing of paper P after the skew (inclination) correction by the registration roller pair 13 to the first conveyor belt 8 based on the detection result of the registration sensor 21.

The first paper sensor 22 is a line sensor that detects the position in the width direction of the paper P sent from the registration roller pair 13 to the first conveyor belt 8. Based on the detection result of the first paper sensor 22, the control unit 110 is able to record an image on the paper P by causing ink to be ejected from the ink ejection openings 18 of the ink ejection ports 18 of the recording heads 17*a* to 17*c* of the line heads 11Y to 11K that correspond to the width of the paper P.

The second paper sensor 23 is a sensor for detecting the position in the conveying direction of the paper P conveyed by the first conveyor belt 8. The second paper sensor 23 is located on the upstream side in the paper conveying direction of the recording unit 9 and on the downstream side of the first paper sensor 22. Based on the detection result of the second paper sensor 23, the control unit 110 is able to control the ink ejection timing for the paper P reaching the position facing the line heads 11Y to 11K (recording heads 17*a* to 17*c*) by the first conveyor belt 8.

Belt sensors 24 and 25 detect the positions of a plurality of opening portion groups 82 (see FIG. 8), which will be described later, provided on the first conveyor belt 8. In other words, the belt sensors 24 and 25 are detection sensors that detect the passage of at least one of the opening groups 82 due to the running of the first conveyor belt 8. The belt sensor 24 is located on the downstream side of the recording unit 9 in the paper conveying direction (the running direction of the first conveyor belt 8). The belt sensor 25 is located at position between the follower roller 6*b* and the other roller 7 where the first conveyor belt 8 is stretched around the follower roller 6*b* and the other roller 7. The follower roller 6*b* is located on the upstream side of the recording unit 9 in the running direction of the first conveyor belt 8. Note that the belt sensor 24 also has the same function as the second paper sensor 23. The control unit 110 is able to control the registration roller pair 13 so as to supply paper P to the first conveyor belt 8 at a specific timing based on the detection result of the belt sensor 24 or 25.

Moreover, the positions of the paper are detected by a plurality of sensors (second paper sensor 23, belt sensor 24), and the positions of the opening portion groups 82 of the first conveyor belt 8 are detected by a plurality of sensors (belt sensors 24 and 25), and as a result, it is possible to correct error in the detected positions and detect an abnormality.

The first paper sensor 22, the second paper sensor 23, and the belt sensors 24 and 25 described above may be configured by a transmissive or reflective optical sensor or a CIS sensor (contact image sensor). Moreover, marks corresponding to the position of the opening portion groups 82 are formed at the end portion in the width direction of the first conveyor belt 8, and the belt sensors 24 and 25 detect the marks, whereby the positions of the opening portion groups 82 may be detected.

The first temperature sensor 41 is a sensor that detects the ambient temperature of the printer 100, and includes, for example, a non-contact temperature sensor such as a radiation thermometer or the like, and is provided on the outer surface of the printer main body 1. The second temperature sensor 42 is a sensor that detects the temperature of the recording heads 17*a* to 17*c*, and includes, for example, a contact type temperature sensor such as a thermistor, a resistance temperature detector, a thermocouple, and the like. The control unit 110 can control the amount of ink ejected from each ink ejection port 18 of the recording heads 17*a* to 17*c* based on the detection result of the first temperature sensor 41 or the second temperature sensor 42; and this will be described later.

In addition, the printer 100 further includes an operation panel 27, a storage unit 28, and a communication unit 29. The operation panel 27 is an operation unit for receiving various setting input from the user. For example, the user may operate the operation panel 27 to input information about the size of the paper P set in the paper feed cassette 2, or in other words, the size of the paper P conveyed by the first conveyor belt 8. The storage unit 28 is a memory that stores an operation program of the control unit 110 and also stores various types of information, and includes a ROM (Read Only Memory), a RAM (Random Access Memory), a non-volatile memory, and the like. Information set by the operation panel 27 (for example, information about the size of the paper P) is stored in the storage unit 28. The communication unit 29 is a communication interface (for example, a personal computer (PC)) for transmitting and receiving information to and from the outside. For example, when the user operates the PC and transmits a print command together with image data to the printer 100, the image data and the print command are inputted to the printer 100 via the communication unit 29. In the printer 100, an image may be recorded on the paper P by the control unit 110 controlling the recording heads 17*a* to 17*c* to eject ink based on the image data. Note that the image data above may also be stored temporarily in the storage unit 28.

Moreover, as illustrated in FIG. 3, the printer 100 has ink receiving units 31Y, 31M, 31C and 31K on the inner peripheral surface side of the first conveyor belt 8. When the recording heads 17*a* to 17*c* are made to execute flushing, the ink receiving units 31Y to 31K receive and collect the ink that has been ejected from the recording heads 17*a* to 17*c* and passed through the opening portions 80 of an opening portion groups 82 of the first conveyor belt 8 described later (see FIG. 8). Therefore, the ink receiving units 31Y to 31K are provided at positions facing the recording heads 17*a* to 17*c* of the line heads 11Y to 11K via the first conveyor belt 8. Note that the ink collected by the ink receiving units 31Y to 31K is sent to, for example, a waste ink tank and disposed of, however, may also be reused without being disposed of.

Here, flushing is the ejection of ink at a timing different from the timing that contributes to image formation (image recording) on the paper P, and is for the purpose of reducing or preventing clogging of the ink ejection ports 18 due to ink drying. The execution of flushing in the recording heads 17*a* to 17*c* is controlled by the control unit 110.

The second conveying unit 12 described above is configured to include a second conveyor belt 12*a* and a dryer 12*b*.

The second conveyor belt 12*a* is stretched around two drive rollers 12*c* and a follower roller 12*d*. The paper P that is conveyed by the first conveying unit 5 and on which an image has been recorded by ink ejected by the recording unit 9 is conveyed by the second conveyor belt 12*a* and dried by the dryer 12*b* while being conveyed to the decurler unit 14 described above.

[2. Details of the First Conveying Unit]

(2-1. Configuration Example of the First Conveying Unit)

In the present embodiment, a negative pressure suction method is adopted as a method for conveying the paper P in the first conveying unit 5. The negative pressure suction method is a method in which the paper P is sucked onto the first conveyor belt 8 by negative pressure suction and conveyed.

Here, as described above, the ink receiving units 31Y to 31K are provided at positions facing the recording heads 17*a* to 17*c* of the line heads 11Y to 11K via the first conveyor belt 8. During negative pressure suction, in a case where the suction force of the area where the ink receiving units 31Y to 31K are provided is strong, the ink ejected from the recording heads 17*a* to 17*c* at the time of flushing vigorously passes through the opening portions 80 of the first conveyor belt 8. Then, the ink may collide with the liquid surface of ink already collected in the ink receiving unit 31Y to 31K, scattering ink into the surroundings and causing a mist to occur. In a case where a mist occurs, the scattered ink adheres to the inner peripheral surface of the first conveyor belt 8 and stains the inner peripheral surface. As a result, the surface of the rollers around which the first conveyor belt 8 is stretched may be stained, and uneven transportation of the first conveyor belt 8 (for example, meandering or slipping) may occur.

Figure 5:
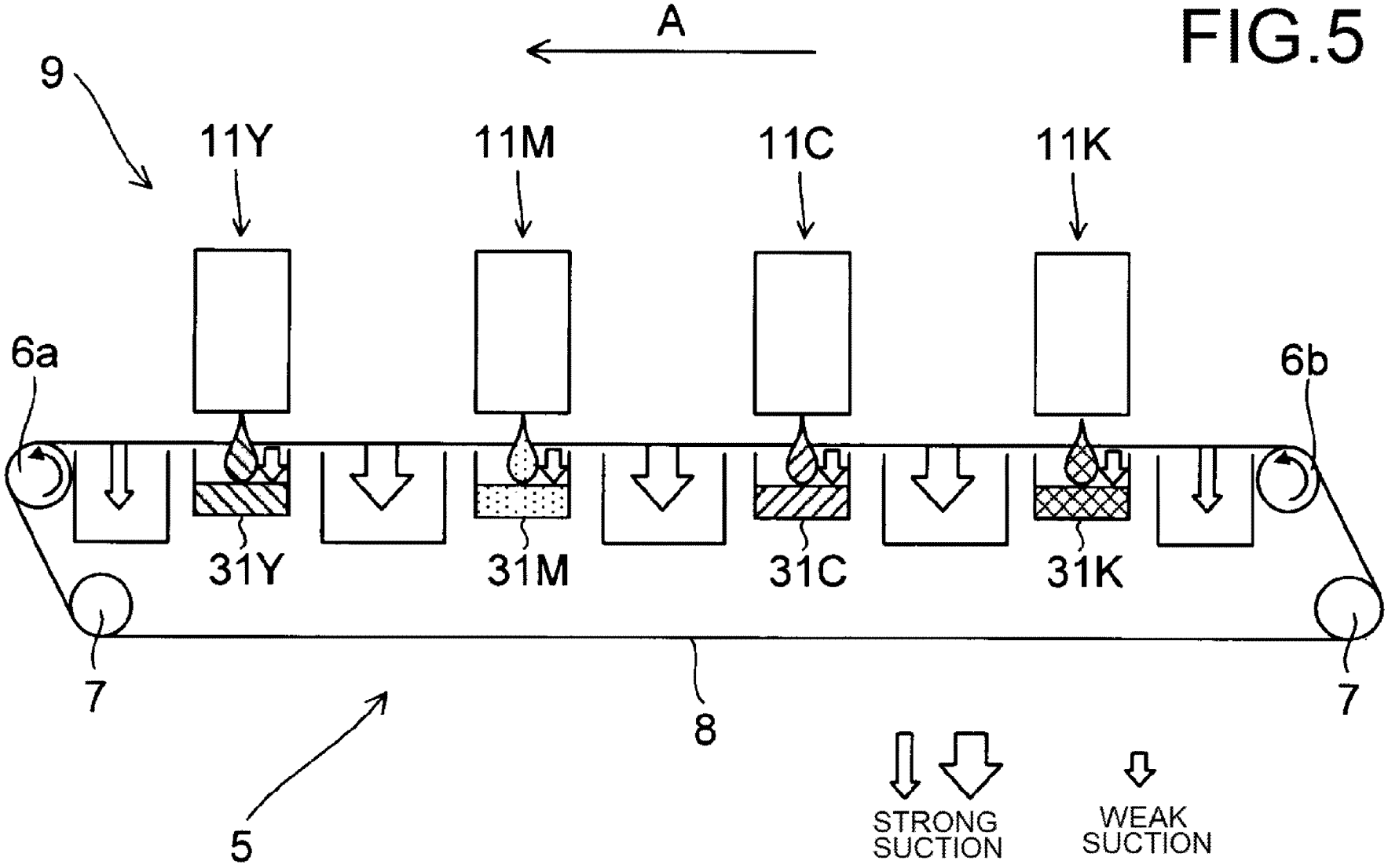
FIG. 5 is an explanatory diagram schematically illustrating an area in the first conveying unit where suction force differs.

Therefore, in the present embodiment, as illustrated in FIG. 5, the suction force of the areas where the ink receiving units 31Y to 31K are provided, or in other words, the areas facing the line heads 11Y to 11K via the first conveyor belt 8 is made to be weaker than the upstream side and downstream side areas in the paper conveying direction. This reduces the above-mentioned inconvenience caused by the mist. More specifically, with the following configuration, areas with different suction forces are generated.

Figure 6:
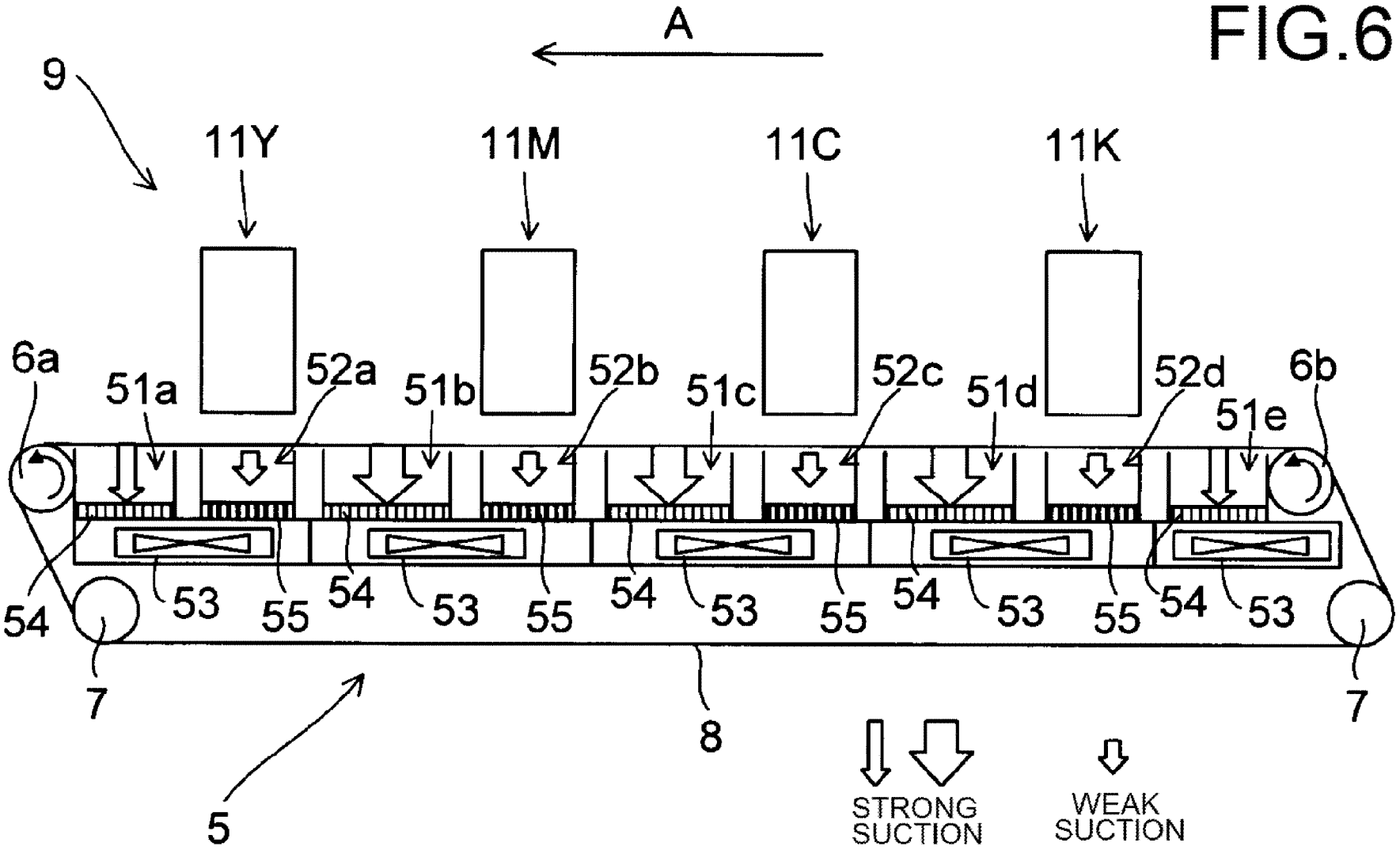
FIG. 6 is an explanatory diagram schematically illustrating a configuration example of the first conveying unit.

FIG. 6 is an explanatory diagram schematically illustrating a configuration example of the first conveying unit 5. First suction chambers 51*a* to 51*e* and second suction chambers 52*a* to 52*d* are provided on the inner peripheral surface side of the first conveyor belt 8 of the first conveying unit 5. The first suction chambers 51*a* to 51*e* and the second suction chambers 52*a* to 52*d* are formed in an elongated shape in the belt width direction of the first conveyor belt 8. The first suction chambers 51*a* to 51*e* and the second suction chambers 52*a* to 52*d* are open on the side facing the first conveyor belt 8.

The first suction chambers 51*a* to 51*e* are provided in this order from the downstream side to the upstream side in the paper conveying direction (direction A). The second suction chamber 52*a* is provided between the first suction chamber 51*a* and the first suction chamber 51*b* at a position facing the line head 11Y via the first conveyor belt 8. The second suction chamber 52*b* is provided between the first suction chamber 51*b* and the first suction chamber 51*c* at a position facing the line head 11M via the first conveyor belt 8. The second suction chamber 52*c* is provided between the first suction chamber 51*c* and the first suction chamber 51*d* at a position facing the line head 11C via the first conveyor belt 8. The second suction chamber 52*d* is provided between the first suction chamber 51*d* and the first suction chamber 51*e* at a position facing the line head 11K via the first conveyor belt 8. The ink receiving units 31Y to 31K described above are arranged in the second suction chambers 52*a* to 52*d*, respectively.

The inner portions of the first suction chambers 51*a* to 51*e* and the second suction chambers 52*a* to 52*d* are sucked by suction members 53. The suction member 53 sucks the paper P onto the first conveyor belt 8 by negative pressure suction. This kind of a suction member 53 is composed of, for example, a fan or a compressor. In the present embodiment, the inner portions of the first suction chamber 51*a* and the second suction chamber 52*a* are sucked by a common suction member 53. Moreover, the inner portions of the first suction chamber 51*b* and the second suction chamber 52*b* are sucked by a common suction member 53. Similarly, the inner portions of the first suction chamber 51*c* and the second suction chamber 52*c* are sucked by a common suction member 53, and the inner portions of the first suction chamber 51*d* and the second suction chamber 52*d* are sucked by a common suction member 53. The first suction chamber 51*e* is sucked alone by a suction member 53.

A filter 54 is arranged in each of the first suction chambers 51*a* to 51*e*, and a filter 55 is arranged in each of the second suction chambers 52*a* to 52*d*. Therefore, when each suction member 53 is driven, the inside of the first suction chambers 51*a* to 51*e* is sucked through the filter 54, and the inside of the second suction chambers 52*a* to 52*d* is sucked through the filter 55. As a result, the inner portions of the first suction chambers 51*a* to 51*e* and the second suction chambers 52*a* to 52*d* have a negative pressure, and air is sucked via the suction holes 8*a* that will be described later (see FIG. 8) or the opening portion groups 82 provided on the first conveyor belt 8, and the paper P is conveyed while being sucked to the first conveyor belt 8.

Here, the filter 54 is configured of a coarser mesh than the filter 55. Therefore, the resistance to the air passing through the filter 54 is lower than the resistance of the air passing through the filter 55. Therefore, in a case where each suction member 53 is driven by the same driving force, the inner portions of the first suction chambers 51*a* to 51*e* are sucked with a relatively strong suction force, and the inner portions of the second suction chambers 52*a* to 52*d* are sucked with a relatively weak suction force. As a result, the speed at which the ink ejected from the recording heads 17*a* to 17*c* during flushing passes through the opening portions 80 of the first conveyor belt 8 is suppressed, and scattering of ink (mist) due to collision with the liquid surface of ink accumulated in the ink receiving units 31Y to 31K may be reduced. This makes it possible to reduce the above-mentioned inconvenience caused by the mist.

(2-2. Other Configuration Example of the First Conveying Unit)

Figure 7:
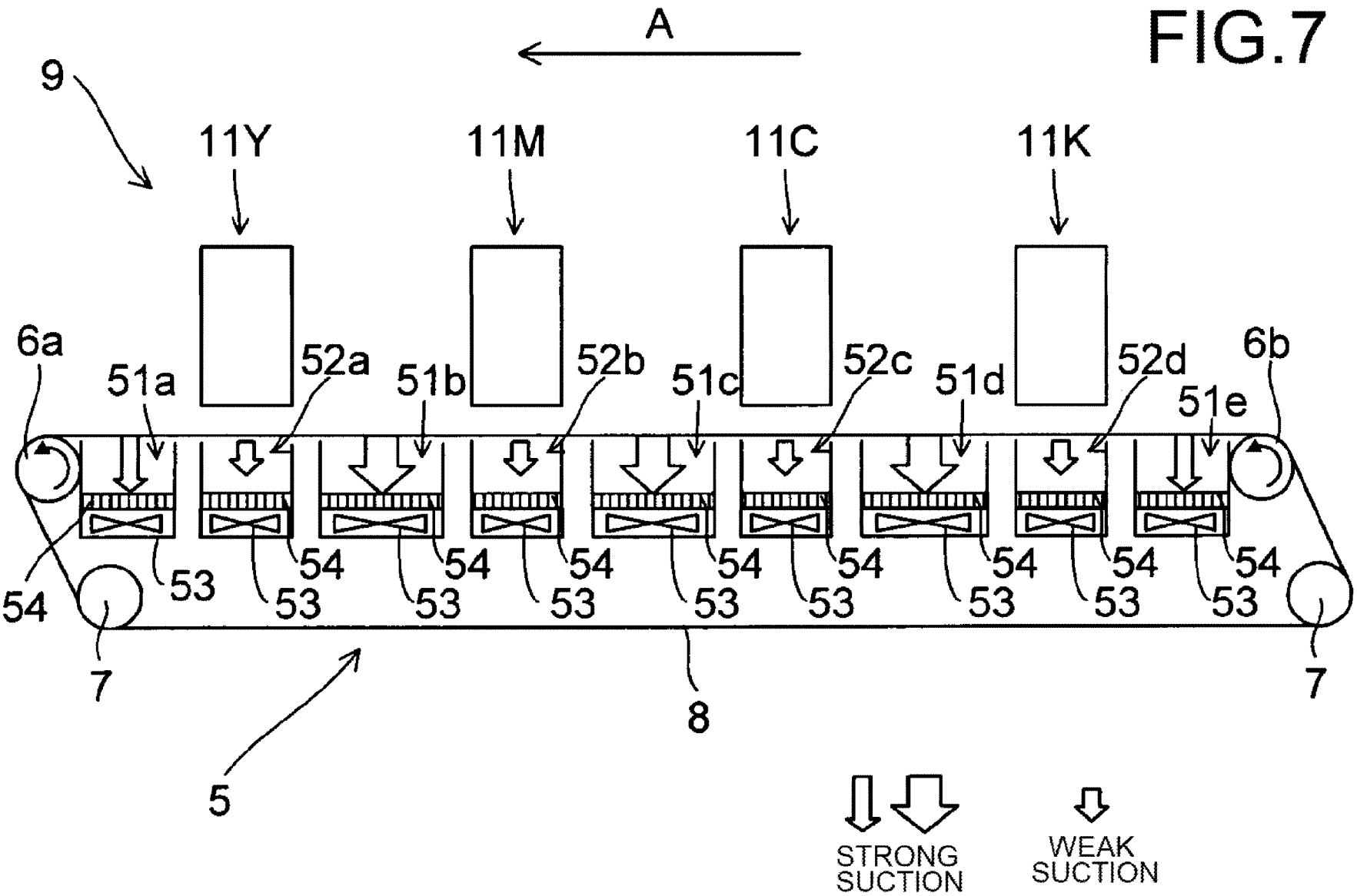
FIG. 7 is an explanatory diagram schematically illustrating another configuration example of the first conveying unit.

FIG. 7 is an explanatory diagram schematically illustrating another configuration example of the first conveying unit 5. In the first conveying unit 5 of FIG. 7, identical filters 54 are arranged in the first suction chambers 51*a* to 51*e* and the second suction chambers 52*a* to 52*d* illustrated in FIG. 6, and each of the first suction chambers 51*a* to 51*e* and the second suction chambers 52*a* to 52*d* is configured to be sucked by a different suction member 53. In such a configuration, by switching the driving force of each suction member 53 that sucks the inner portions of the second suction chambers 52*a* to 52*d*, the suction force of the second suction chambers 52*a* to 52*d* is switched between strong suction and weak suction. Note that the driving of each suction member 53 is controlled by the control unit 110, for example.

For example, when ink is ejected onto the paper P conveyed by the first conveyor belt 8 (at the time of recording an image), all of the suction members 53 that suck the first suction chambers 51*a* to 51*e* and the second suction chambers 52*a* to 52*d* are driven by a first driving force. On the other hand, at the time of flushing, each suction member 53 that sucks the first suction chambers 51*a* to 51*e* is driven by the first driving force, and each suction member 53 that sucks the second suction chambers 52*a* to 52*d* is driven by a second driving force that is lower than the first driving force. As a result, at the time of recording an image, the first suction chambers 51*a* to 51*e* and the second suction chambers 52*a* to 52*d* are strongly sucked to convey the paper P, and at the time of flushing, only the second suction chambers 52*a* to 52*d* are weakly sucked, making it possible to reduce mist. This makes it possible to reduce the above-mentioned inconvenience caused by the mist.

In addition, instead of using the filters 54 or 55, the diameters (flow passage cross-sectional areas) of the pipes that are the flow passages of the air sucked from the first suction chambers 51*a* to 51*e* and the second suction chambers 52*a* to 52*d* are made different. In doing so, the suction force may be made different between the first suction chambers 51*a* to 51*e* and the second suction chambers 52*a* to 52*d*.

[3. Details of the First Conveyor Belt]

(3-1. Configuration Example of the First Conveyor Belt)

Figure 8:
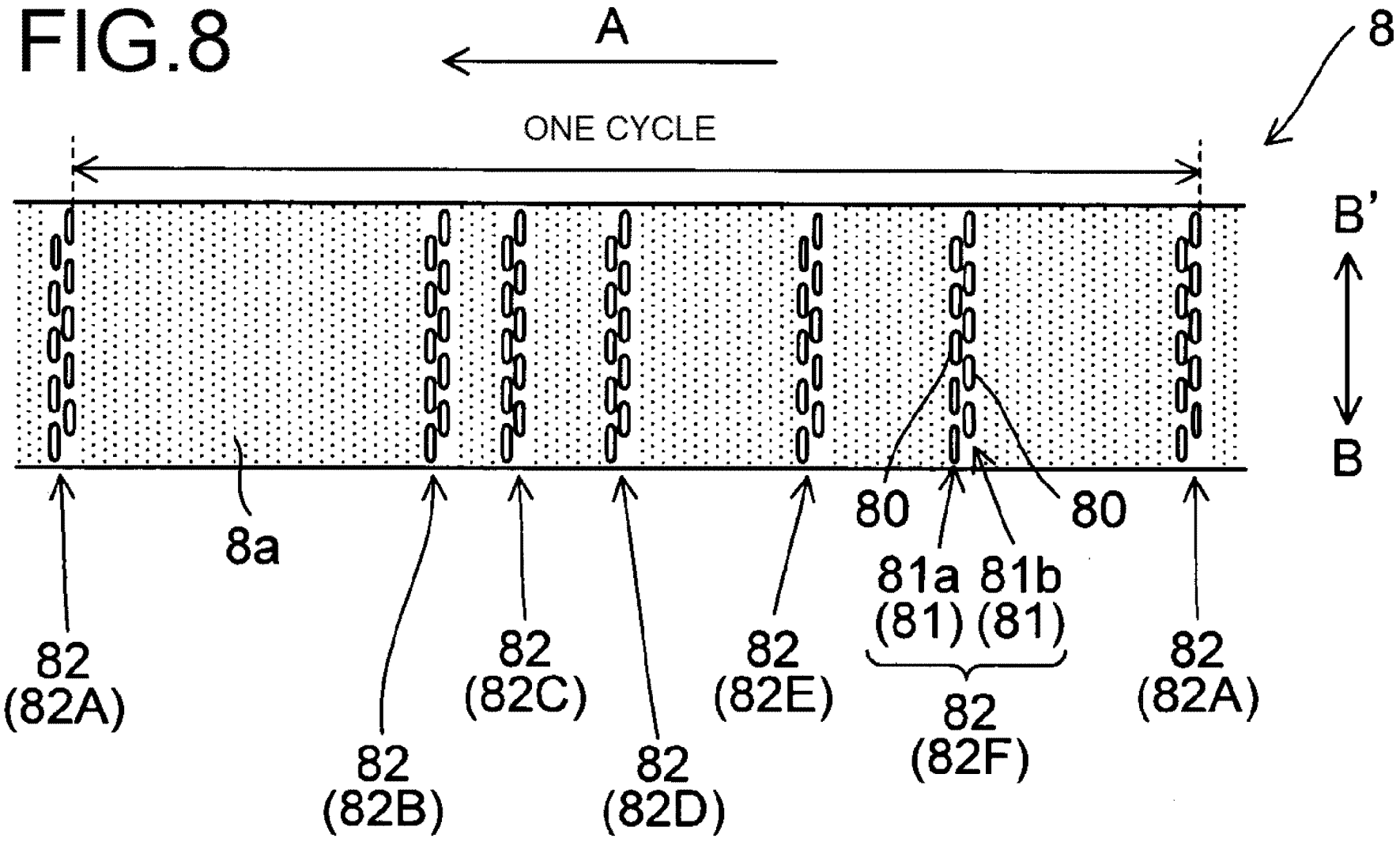
FIG. 8 is a plan view illustrating a configuration example of a first conveyor belt of the first conveying unit.

Next, details of the first conveyor belt 8 of the first conveying unit 5 will be described. FIG. 8 is a plan view illustrating a configuration example of the first conveyor belt 8. In the present embodiment, as described above, paper P is conveyed by the negative pressure suction method. In order for this, as illustrated in FIG. 8, the first conveyor belt 8 is provided with innumerable suction holes 8*a* through which suction air generated by negative pressure suction of the suction member 53 passes.

Moreover, the first conveyor belt 8 is also provided with opening portion groups 82. The opening portion groups 82 are sets of opening portions 80 through which ink ejected from each nozzle (ink ejection ports 18) of the recording heads 17*a* to 17*c* passes during flushing. The opening area of each of the opening portions 80 is larger than the opening area of each of the above-mentioned suction holes 8*a*. The first conveyor belt 8 has a plurality of opening portion groups 82 in one cycle in the conveying direction (direction A) of the paper P, and in the present embodiment there is six. Note that when distinguishing the opening portion groups 82 from each other, the six opening portion groups 82 are referred to as opening portion groups 82A to 82F from the downstream side in the A direction. The above-mentioned suction holes 8*a* are located between an opening portion group 82 and opening portion group 82 that are adjacent to each other in the A direction. In other words, in the first conveyor belt 8, the suction holes 8*a* are not formed in a region that overlaps an opening portion group 82.

The opening portion groups 82 are irregularly positioned in the A direction in one cycle of the first conveyor belt 8. In other words, in the A direction, the interval between an opening portion group 82 and the adjacent opening group 82 is not constant but changes (there are at least two types of the above-mentioned intervals). In this case, the maximum interval between two adjacent opening portion groups 82 in the A direction (for example, the distance between the opening portion group 82A and the opening portion group 82B in FIG. 8) is longer than the length in the A direction of the paper P when the minimum printable size (for example, A4 size horizontal placement)) paper P is placed on the first conveyor belt 8.

The opening portion groups 82 have opening portion rows 81. The opening portion rows 81 are configured by arranging a plurality of opening portions 80 in the belt width direction (paper width direction, BB' direction) orthogonal to the A direction. One opening portion group 82 has a plurality of opening portion rows 81 in the A direction, and in the present embodiment, has two opening portion rows 81. Note that when distinguishing the two opening portion rows 81 from each other, one is opening portion row 81*a* and the other is opening portion row 81*b*.

In one opening group 82, the opening portions 80 of any one of the opening portion rows 81 (for example, the opening portion row 81*a*) are positioned offset in the BB' direction with respect to the opening portions 80 of the other opening row 81 (for example, the opening row 81*b*). Furthermore, the opening portions 80 are positioned so as to overlap a part of the opening portions 80 of the other opening portion row 81 (for example, the opening row 81*b*) when viewed in the A direction. In addition, in each opening portion row 81, the plurality of opening portions 80 are located at equal intervals in the BB' direction.

As described above, by arranging the plurality of opening portion rows 81 in the A direction to form one opening portion group 82, the width of the opening portion group 82 in the BB' direction is larger than the width of the recording heads 17*a* to 17*c* in the BB' direction. Therefore, the opening portion groups 82 cover all the ink ejection areas of the recording heads 17*a* to 17*c* in the BB' direction, and the ink ejected from all the ink ejection ports 18 of the recording heads 17*a* to 17*c* during flushing passes through the opening portions 80 of one of the opening portion groups 82.

(3-2. Opening Portion Group Pattern Used During Flushing)

In the present embodiment, the control unit 110 records an image on paper P by driving the recording heads 17*a* to 17*c* based on image data transmitted from the outside (for example, a PC) while paper P is conveyed using the first conveyor belt 8 described above. At this time, by causing the recording heads 17*a* to 17*c* to perform flushing (inter-paper flushing) between the conveyed paper P and paper P, clogging of the ink ejection ports 18 is reduced or prevented.

Here, in the present embodiment, the control unit 110 sets the pattern (combination) in the A direction of the plurality of opening portion groups 82 used during flushing according to the size of the paper P to be used in one cycle of the first conveyor belt 8. Note that the size of the paper P to be used may be recognized by the control unit 110 based on information stored in the storage unit 28 (size information about the paper P inputted using the operation panel 27).

Figure 9:
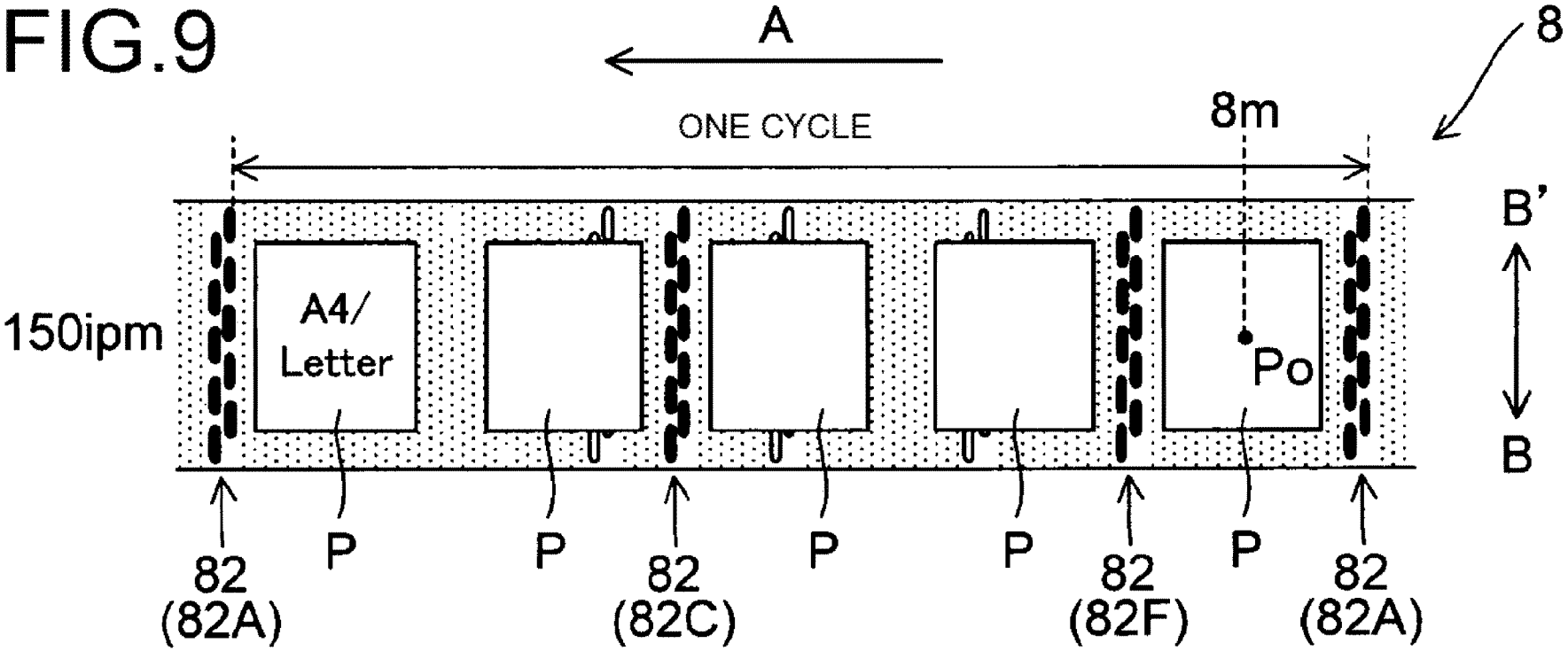
FIG. 9 is an explanatory diagram schematically illustrating an example of a pattern of a group of opening portions for flushing when the first conveyor belt of FIG. 8 is used, and illustrates paper arranged on the first conveyor belt according to the pattern.
Figure 10:
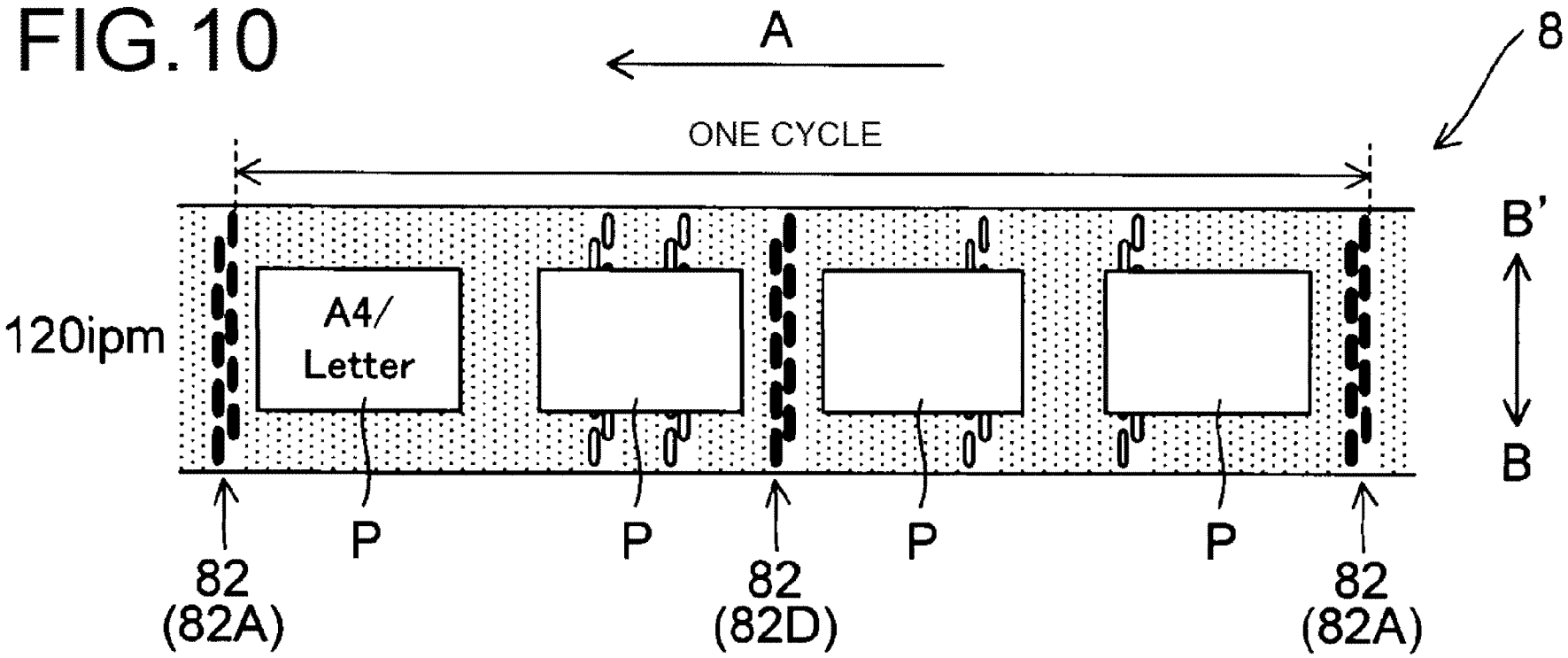
FIG. 10 is an explanatory diagram schematically illustrating another example of the pattern and paper arranged on the first conveyor belt according to the pattern.
Figure 11:
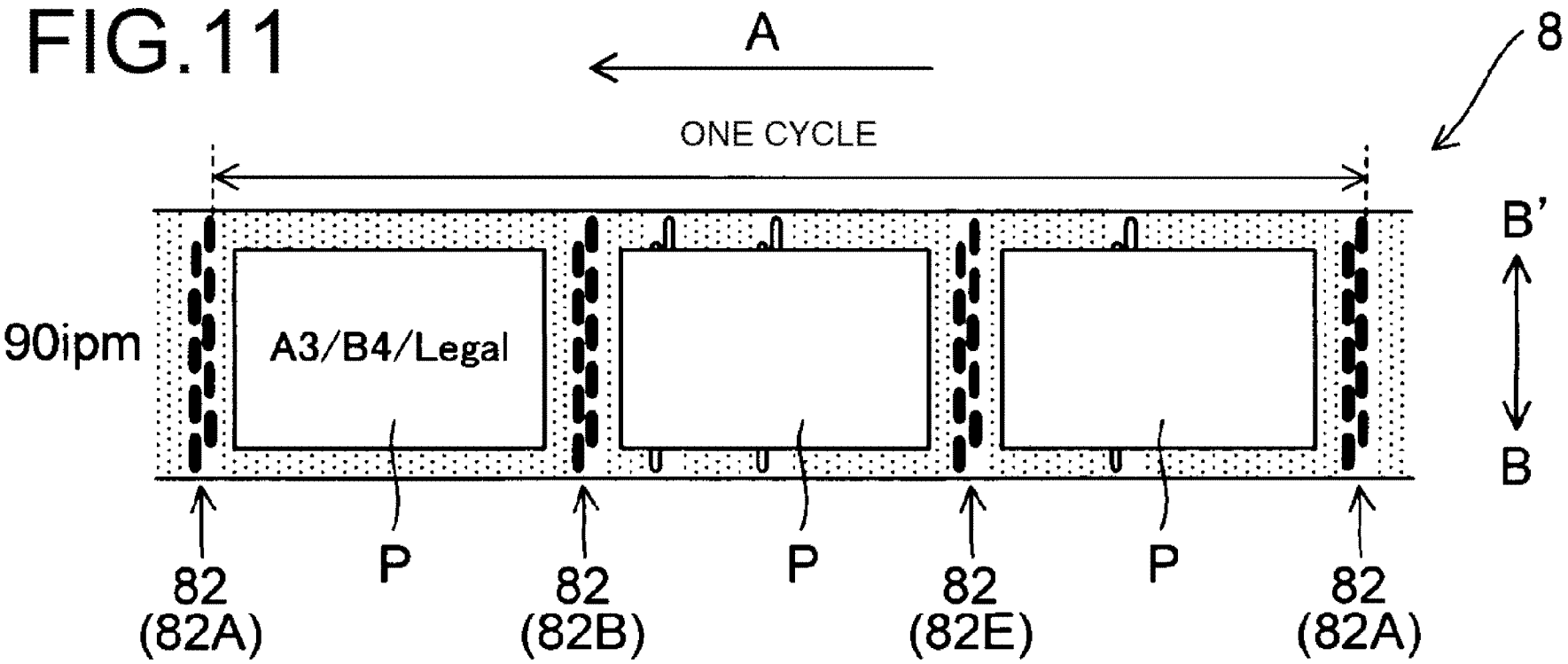
FIG. 11 is an explanatory diagram schematically illustrating yet another example of the pattern and paper arranged on the first conveyor belt according to the pattern.
Figure 12:
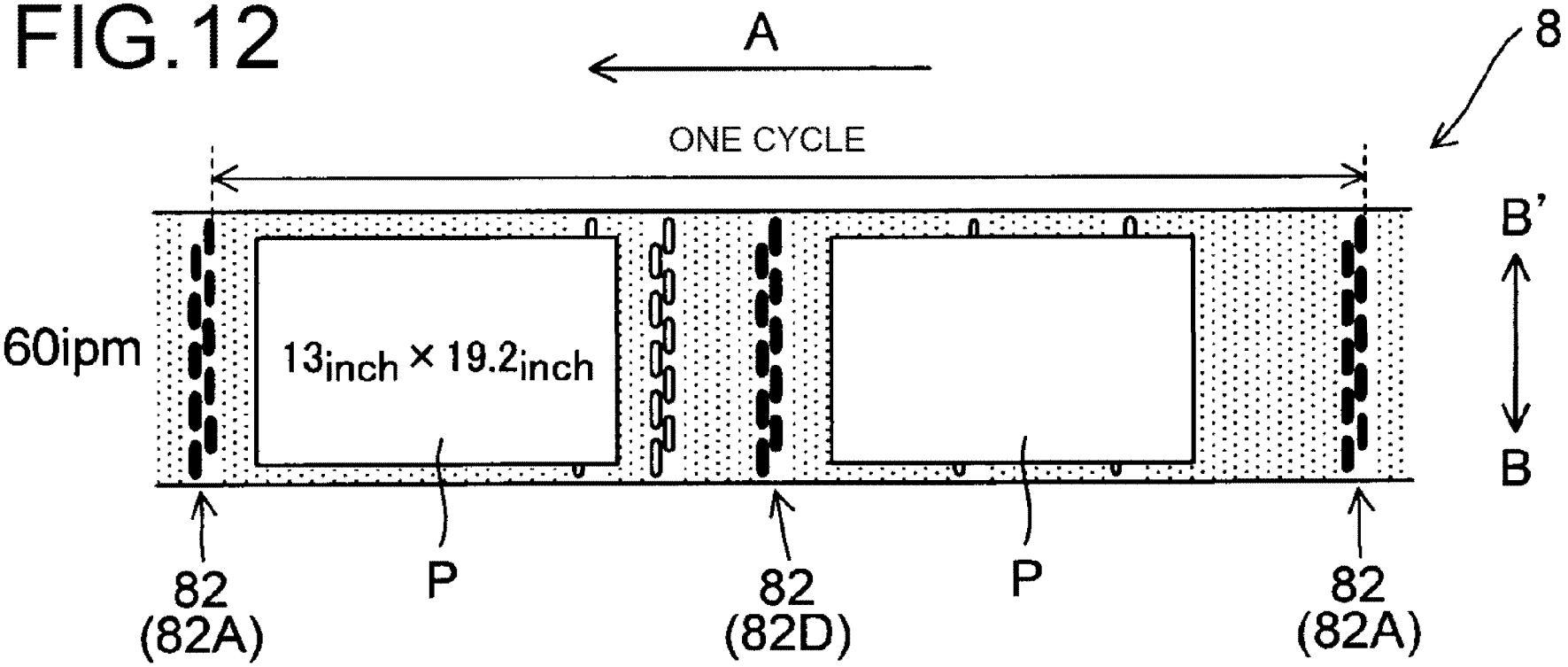
FIG. 12 is an explanatory diagram schematically illustrating yet another example of the pattern and paper arranged on the first conveyor belt according to the pattern.

FIGS. 9 to 12 each illustrates an example of the above patterns for each kind of paper P. For example, in a case where the paper P to be used is A4 size (horizontal placement) or letter size (horizontal placement), the control unit 110 selects the pattern of the opening portion groups 82 illustrated in FIG. 9. In other words, the control unit 110 selects the opening portion groups 82A, 82C, 82F from among the six opening portion groups 82 illustrated in FIG. 8 as the opening portion groups 82 to be used during flushing. In a case where the paper P to be used is A4 size (vertical placement) or letter size (vertical placement), the control unit 110, as illustrated in FIG. 10, selects the opening portion groups 82A, 82D, from among the six opening portion groups 82 as the opening portion groups 82 to be used for flushing. In a case where the paper P to be used is A3 size, B4 size, or legal size (all vertically placed), the control unit 110, as illustrated in FIG. 11, selects the opening portion groups 82A, 82B, 82E from among the six opening groups 82 as the opening portion groups 82 to be used during flushing. In a case where the paper P to be used is size 13 inches×19.2 inches, the control unit 110, as illustrated in FIG. 12, selects the opening portion groups 82A, 82D from among the six opening groups 82 as the opening portion groups 82 to be used during flushing. Note that in each of the figures, the opening portions 80 of the opening portion groups 82 belonging to the above patterns are illustrated in black for convenience.

Then, the control unit 110, by the running of the first conveyor belt 8, causes the recording heads 17*a* to 17*c* to execute flushing at the timing when the opening portion groups 82 positioned in the determined pattern face the recording heads 17*a* to 17*c*. Here, the running speed of the first conveyor belt 8 (paper conveying speed), the spacing between the opening portion groups 82A to 82E, and the positions of the recording heads 17*a* to 17*c* with respect to the first conveyor belt 8 are all understandable. Therefore, when the belt sensor 24 or 25 detects that a reference opening portion group 82 (for example, the opening portion group 82A) has passed due to the running of the first conveyor belt 8, it is understood how many seconds after the detection time the opening groups 82A to 82E pass through the positions facing the recording heads 17*a* to 17*c*. Therefore, the control unit 110, based on the detection results of the belt sensor 24 or 25, is able to cause the recording heads 17*a* to 17*c* to execute flushing at timing when the opening portion groups 82 positioned in the determined pattern described above face the recording heads 17*a* to 17*c*.

At this time, the control unit 110, based on the detection result of the belt sensor 24 or 25, controls flushing by the recording heads 17*a* to 17*c* so that the ink passes through the same opening portion group 82 in each cycle of the first conveyor belt 8 for each class determined according to the size of the paper P.

For example, a case (first class) where the size of the paper P used is A4 size (horizontal placement) or letter size (horizontal placement) will be described. In this case, the control unit 110 controls flushing by the recording heads 17*a* to 17*c* so that ink passes trough the same opening portion groups 82A, 82C, 82F illustrated in FIG. 9 in each cycle of the first conveyor belt 8. A case (second class) where the size of the paper P used is A4 size (vertical placement) or letter size (vertical placement) will be described. In this case, the control unit 110 controls flushing by the recording heads 17*a* to 17*c* so that ink passes trough the same opening portion groups 82A, 82D illustrated in FIG. 10 in each cycle of the first conveyor belt 8. A case (third class) where the size of the paper P used is A3 size, B4 size or legal size (each vertically placed) will be described. In this case, the control unit 110 controls flushing by the recording heads 17*a* to 17*c* so that ink passes trough the same opening portion groups 82A, 82B, 82E illustrated in FIG. 11 in each cycle of the first conveyor belt 8. A case (fourth class) where the size of paper P used is 13 inches×19.2 inches will be described. In this case, the control unit 110 controls flushing by the recording heads 17*a* to 17*c* so that ink passes trough the same opening portion groups 82A, 82D illustrated in FIG. 12 in each cycle of the first conveyor belt 8.

Moreover, the control unit 110 controls the supply of the paper P to the first conveyor belt 8 so as to be shifted in the A direction from the opening portion groups 82 positioned in the determined pattern. In other words, the control unit 110 causes the registration roller pair 13 as a recording medium supply unit to supply the paper P between the plurality of opening portion groups 82 arranged in the A direction in the pattern described above on the first conveyor belt 8.

For example, a case where the paper P used is A4 size (horizontal placement) or letter size (horizontal placement) will be described. In this case, as illustrated in FIG. 9, the control unit 110 controls the registration roller pair 13 to supply the paper P to the first conveyor belt 8 at a specific supply timing so that on the first conveyor belt 8, two sheets of paper P are arranged between the opening portion group 82A and the opening portion group 82C, two sheets of paper P are arranged between the opening portion group 82C and the opening portion group 82F, one sheet of paper P is arranged between the opening group 82F and the opening group 82A. In this case, the control unit 110 controls the registration roller pair 13 to supply paper P to the first conveyor belt 8 so that on the first conveyor belt 8 each sheet of paper P is arranged at a position separated from the opening portion groups 82A, 82C, 82F positioned in the above pattern by a specific distance or more in the A direction (including both upstream and downstream directions). Note that the specific distance above is set to 10 mm as an example here.

Here, the supply timing of the paper P by the registration roller pair 13 can be determined by the control unit 110 based on the detection result of the belt sensor 24 or 25. For example, the belt sensor 24 or 25 detects that a reference opening portion group 82 (for example, the opening portion group 82A) has passed by due to the running of the first conveyor belt 8. Then, the control unit 110 is able to determine how many seconds after the detection time the paper P can be arranged at each position illustrated in FIG. 9 by supplying the paper P to the first conveyor belt 8 by the registration roller pair 13. Therefore, the control unit 110 determines the supply timing of the paper P based on the detection result of the belt sensor 24 or 25, and controls the registration roller pair 13 so that the paper P is supplied at the determined supply timing. As a result, the paper P can be arranged on the first conveyor belt 8 at the respective positions illustrated in FIG. 9 at approximately equal intervals. In the example of FIG. 9, five sheets of paper P can be conveyed in one cycle of the first conveyor belt 8, and 150 ipm (images per minute) can be achieved as the number of printed sheets of paper P per minute (productivity).

Furthermore, as illustrated in FIG. 9, in a case where A4 size (horizontal placement) paper P is supplied to the first conveyor belt 8, only one sheet of paper P is supplied between the opening portion group 82F and the opening portion group 82A of the first conveyor belt 8. In this case, the control unit 110 controls the registration roller pair 13 based on the detection result of the belt sensor 24 or 25, so that the center Po of the paper P in the A direction is located at an intermediate position 8*m* between the opening portion group 82F and the opening portion group 82A. Then, the control unit 110 causes paper P to be supplied from the registration roller pair 13 to the first conveyor belt 8.

On the other hand, a case where the paper P used is A4 size (vertical placement) or letter size (vertical placement) will be described. In this case, as illustrated in FIG. 10, the control unit 110 controls the registration roller pair 13 so that two sheets of paper P are arranged on the first conveyor belt 8 between the opening portion group 82A and the opening portion group 82D, and so that two sheets of paper P are arranged between the opening portion group 82D and the opening portion group 82A, then causes the paper P to be supplied to the first conveyor belt 8 at a specific supply timing. In the example of FIG. 10, four sheets of paper P can be conveyed in one cycle of the first conveyor belt 8, and a productivity of 120 ipm can be achieved.

A case in which the paper P to be used is A3 size, B4 size, or legal size (all vertically place) will be described. In this case, as illustrated in FIG. 11, the control unit 110 controls the registration roller pair 13 so that one sheet of paper P is arranged between the opening portion group 82A and the opening portion group 82B, one sheet of paper P is arranged between the opening portion group 82B and the opening portion group 82E, and one sheet of paper P is arranged between the opening group 82E and the opening group 82A. The control unit 110 causes the paper P to be supplied to the first conveyor belt 8 at a specific supply timing. In the example of FIG. 11, three sheets of paper P can be conveyed in one cycle of the first conveyor belt 8, and a productivity of 90 ipm can be achieved. Note that preferably the control unit 110 causes the paper P to be supplied to the first conveyor belt 8 by controlling the registration roller pair 13 based on the detection result of the belt sensor 24 or 25 so that the center of one sheet of paper P in the A direction is positioned at an intermediate position between two adjacent opening portion groups 82 included in the determined pattern.

A case in which the paper P used has a size of 13 inches×19.2 inches will be described. In this case, as illustrated in FIG. 12, the control unit 110 controls the registration roller pair 13 so that one sheet of paper P is arranged on the first conveyor belt 8 between the opening portion group 82A and the opening portion group 82D, and so that one sheet of paper P is arranged between the opening portion group 82D and the opening portion group 82A. Then, the control unit 110 causes the paper P to be supplied to the first conveyor belt 8 at a specific supply timing. In the example of FIG. 12, two sheets of paper P can be conveyed in one cycle of the first conveyor belt 8, and a productivity of 60 ipm can be achieved.

As described above, in the present embodiment, as illustrated in FIG. 8, the endless first conveyor belt 8 has a plurality of opening portion groups 82 in the A direction. In this configuration, as illustrated in FIGS. 9 to 12, the pattern of the opening portion groups 82 used for flushing may be determined (selected) according to the size of the paper P during one cycle of the first conveyor belt 8. Then, using the opening portion groups 82 positioned in the determined pattern, the recording heads 17*a* to 17*c* can be flushed a plurality of times during one cycle of the first conveyor belt 8. Therefore, regardless of the size of the paper P used, insufficient flushing and the resulting clogging of the nozzles can be reduced.

Moreover, regardless of the size of the paper P used, as much paper P as possible may be arranged on the first conveyor belt 8 so as not to overlap the opening portion groups 82 arranged in the selected pattern. Therefore, it is possible to avoid a decrease in productivity (decrease in the number of printed sheets) regardless of the size of the paper P used. Furthermore, in order to eliminate insufficient flushing, it is not necessary to reduce the conveying speed of the paper P as in a conventional case, which also contributes to the improvement of productivity. In addition, since it is not necessary to change the conveying speed of the paper P, complicated control for conveying the paper P (complex drive control of the first conveyor belt 8) becomes unnecessary.

Moreover, in the printer 100 of the present embodiment, the minimum size of the paper P used for printing is A4 size (horizontal placement) or letter size (horizontal placement). Then, as illustrated in FIG. 9, a plurality of sheets (for example, 5 sheets) of the minimum size paper P are conveyed in one cycle of the first conveyor belt 8. On the other hand, for paper P of other sizes, as illustrated in FIGS. 10 to 12, an integer number of sheets is conveyed during one cycle of the first conveyor belt 8. In other words, the control unit 110 determines the supply timing at which the paper P is supplied to the first conveyor belt 8 according to the size of the paper P so that an integer number of other sizes of paper P are conveyed during one cycle of the first conveyor belt 8 that conveys a plurality of sheets of the minimum size of paper P. Then, the control unit 110 causes the paper P to be supplied from the registration roller pair 13 to the first conveyor belt 8 at the determined supply timing.

For example, in a case where 2.5 sheets of paper P of the same size are conveyed in one cycle of the first conveyor belt 8 (case where the third sheet P is supplied crossing over the first cycle and the second cycle of the first conveyor belt 8) will be described. In this case, even though the first sheet of paper P does not overlap the opening portion group 82A in the first cycle of the first transport belt 8, the third sheet of paper P will be conveyed overlapping the opening portion group 82A in the second cycle. In this case, when the opening group 82A is stained with the ink at the time of flushing in the first cycle, when the third sheet P overlaps with the opening portion group 82A in the second cycle, there is a concern that the third sheet P will become stained.

In the present embodiment, an integer number of sheets P are conveyed for any size of paper P during one cycle of the first conveyor belt 8. As a result, for any size of paper P, the paper P is conveyed so as not to cross over from the previous cycle to the next cycle of the first conveyor belt 8. In other words, the paper P can be arranged and conveyed in the next cycle of the first conveyor belt 8 so as not to overlap with the opening portion group 82 used for flushing in the cycle of the first conveyor belt 8 immediately before. Therefore, for any size of paper P, it is possible to reduce situations where the paper P becomes stained in each cycle of the first conveyor belt 8.

Moreover, since a plurality of sheets of the minimum size paper P are conveyed in one cycle of the first conveyor belt 8, it should be possible to improve at least the productivity of the minimum size paper P, while at the same time secure the productivity of other sizes. In particular, in the present embodiment, as illustrated in FIGS. 10 to 12, a plurality of sheets of paper P other than the minimum size are also conveyed in one cycle of the first transport belt 8, so that the productivity of paper P other than the minimum size may also be achieved.

In addition, in the configuration in which an integer number of sheets of paper P are conveyed during one cycle of the first conveyor belt 8, flushing can be performed using the same opening portion group 82 that is not overlapped by the paper P in each cycle of the first conveyor belt 8. As a result, it is not necessary to change the flushing timing in each cycle. Therefore, flushing control (ink ejection control of the recording heads 17*a* to 17*c*) by the control unit 110 becomes easy over all cycles of the first conveyor belt 8.

Further, as illustrated in FIGS. 9 to 12, the number of sheets of paper P to be conveyed in one cycle of the first conveyor belt 8 is 5 sheets for A4 size (horizontal placement) and letter size (horizontal placement). There are 4 sheets for A4 size (vertical placement) and letter size (vertical placement). There are 3 sheets for A3 size, B4 size and legal size. There are 2 sheets for a size of 13 inches×19.2 inches. In other words, the number of sheets of paper P to be conveyed in one cycle of the first conveyor belt 8 differs for each class determined according to the size of the paper P.

In this case, different productivity can be achieved for each class to which the paper P belongs.

Furthermore, in the present embodiment, as illustrated in FIGS. 9 to 12, the control unit 110 causes the paper P to be supplied from the registration roller pair 13 to the first conveyor belt 8 at fixed intervals. In other words, the control unit 110 determines the supply timing for supplying the paper P so that the paper P is arranged at equal intervals in the A direction on the first conveyor belt 8. In this case, the supply of the paper P to the first conveyor belt 8 by the registration roller pair 13 may be controlled at a fixed timing, so the supply control of the paper P (control of the registration roller pair 13) becomes easy.

Moreover, in the present embodiment, the control unit 110 causes the recording heads 17*a* to 17*c* to perform flushing at timing when the opening portion group 82 located in the determined pattern faces the recording heads 17*a* to 17*c*. In other words, in the control unit 110 causes flushing of the recording heads 17*a* to 17*c* to be executed at timing when due to the running of the first conveyor belt 8 the opening group 82 located between any two sheets P arranged in the A direction on the first conveyor belt 8 faces the recording heads 17*a* to 17*c*. As a result, flushing can be performed at appropriate timing according to the size of the paper P being used. Therefore, regardless of the size of the paper P, it is possible to eliminate insufficient flushing while avoiding a decrease in the productivity of the paper P.

In addition, the control unit 110 determines a pattern arranged in the A direction of the opening portion groups 82 used for flushing in one cycle of the first conveyor belt 8 according to the size of the paper P to be used. Then, the control unit 110 determines the supply timing so that the paper P is supplied between the plurality of opening portion groups 82 located in the A direction in the determined pattern on the first conveyor belt 8.

As a result, as illustrated in FIGS. 9 to 12, the number of sheets of paper P to be placed can be set for each size of paper P so that as much paper P as possible is placed between opening portion group 82 and opening group 82 arranged in the determined pattern in one cycle of the first conveyor belt 8. Therefore, regardless of the size of the paper P used, the number of sheets of the paper P to be conveyed during one cycle of the first conveyor belt 8 is maintained, and it is possible to avoid a decrease in the productivity of the paper P (decrease in the number of printed sheets). Furthermore, regardless of the size of the paper P used, flushing can be performed a plurality of times by using a plurality of opening portion groups 82 arranged in the above pattern during one cycle of the first conveyor 8. As a result, insufficient flushing and resulting clogging of the nozzles may be reduced.

Moreover, in the present embodiment, the storage unit 28 stores information about the size of the paper P inputted in advance using the operation panel 27, or in other words, information about the size of the paper P conveyed by the first conveyor belt 8. Then, the control unit 110 recognizes the size of the paper P to be used based on the information stored in the storage unit 28, and determines the pattern of the opening portion groups 82 according to the recognized size. For example, the printer 100 has a sensor that detects the size of the paper P to be used, and the control unit 110 is able to determine the pattern of the opening portion groups 82 according to the size detected by the sensor, and in this case, a dedicated sensor for detecting the size of the paper P is required. In the present embodiment, the control unit 110 recognizes the size of the paper P and determines the pattern based on the information stored in the storage unit 28, so the effect of this embodiment can be obtained by determining the above pattern without separately providing a dedicated sensor for detecting the size of the paper P.

Further, the printer 100 of the present embodiment includes a belt sensor 24 or 25 as a detection sensor for detecting the passage of at least one of the opening portion groups 82 due to the running of the first conveyor belt 8. Then, the control unit 110 determines the above supply timing based on the detection result (position of the opening portion groups 82) by the belt sensor 24 or 25. As a result, the control unit 110 controls the registration roller pair 13 so that the paper P is supplied to the first conveyor belt 8 at the supply timing. As a result, the control unit 110 is able to reliably arrange the paper P between adjacent opening portion groups 82 of the first conveyor belt 8 and convey an integer number of sheets of paper P during one cycle of the first conveyor belt 8.

In addition, in the present embodiment, the control unit 110 controls the flushing in the recording heads 17*a* to 17*c* based on the detection result of the belt sensor 24 or 25 so that ink passes through the same opening portion groups 82 in each cycle of the first conveyor belt 8 for each class determined according to the size of the paper P. In this case, in each cycle of the first conveyor belt 8, the other opening portion groups 82 are not stained with ink during flushing. Therefore, regardless of the class of paper P, in each cycle of the first conveyor belt 8, such a conveyance of paper P is possible with no concern that the paper P will be stained even though conveyed so as to overlap another opening portion group 82. In other words, regardless of the class of paper P, in each cycle, it is possible convey the paper P without being stained by arranging the paper P so as to avoid the opening portion group 82 through which ink passes during flushing.

In addition, as illustrated in FIG. 9, the A4 size (horizontal placement) and the letter size (horizontal placement) belong to the same class (first class). Then, in this class, the opening group portions 82 used for flushing are in a fixed pattern of the opening portion groups 82A, 82C, 82F. In addition, as illustrated in FIG. 10, the A4 size (vertical placement) and the letter size (vertical placement) belong to the same class (second class). Then, in this class, the opening group portions 82 used for flushing are in a fixed pattern of the opening portion groups 82A and 82D. In addition, as illustrated in FIG. 11, the A3 size, the B4 size, and the legal size (all vertically placed) belong to the same class (third class). Then, in this class, the opening group portions 82 used for flushing are in a fixed pattern of the opening portion groups 82A, 82B and 82E. Furthermore, as illustrated in FIG. 12, the size of 13 inches×19.2 inches independently constitutes one class (fourth class). Then, in this class, the opening group portions 82 used for flushing are in a fixed pattern of the opening portion groups 82A and 82D.

As described above, the pattern of the opening portion groups 82 used during flushing is a fixed pattern for each class determined according to the size of the paper P. In this case, the control unit 110 may perform the ejection control of ink in the recording heads 17*a* to 17*c* for each class in a pattern corresponding to the pattern of the opening portion groups 82 during flushing, and thus the ejection control is easy.

Moreover, the patterns of the opening portion groups 82 used during flushing are different from each other in FIGS. 9 and 10, FIGS. 10 and 11, and FIGS. 11 and 12. On the other hand, the above patterns are the same in FIG. 10 and FIG. 12. From this, it can be said that the patterns differ between at least two classes determined according to the size of the paper P. With such a pattern setting, flushing can be executed on any size (class) of paper P by using the opening portion groups 82 having an appropriate pattern without lowering productivity.

Moreover, in the present embodiment, the first conveyor belt 8 further has suction holes 8*a* in addition to the opening portions 80 described above. Then, in the first conveyor belt 8, the size of the opening portions 80 (opening area) is larger than the size (opening area) of the suction holes 8*a*. For example, there is a concern that if the suction holes 8*a* are large, the ink ejected from the recording heads 17*a* to 17*c* during flushing deviates from the direction toward the opening portions 80 toward the suction holes 8*a* and collides with the surroundings of the opening portions 80, causing a splash. By making the suction holes 8*a* relatively smaller than the opening portions 80, it is possible to reduce the occurrence of the splashing described above and reduce staining of the paper P due to splashing.

In addition, the opening portion groups 82 of the first conveyor belt 8 are irregularly positioned in the A direction in one cycle of the first transport belt. In this case, the effect of the present embodiment described above can be obtained by using the first conveyor belt 8 in which the minimum necessary opening portion groups 82 that can correspond to the sizes of the plurality of sheets of paper P are arranged in the A direction. Furthermore, by keeping the number of the opening portion groups 82 to the necessary minimum, it is easy to maintain the strength of the first conveyor belt 8.

Moreover, in the first transport belt 8, the opening group 82 has a plurality of opening portion rows 81 in the A direction. Then, the opening portions 80 of one of the opening portion rows 81 (for example, the opening portion row 81*a*) is positioned so as to be offset from the opening portions 80 of the other opening portion row 81 (for example, the opening portion row 81*b*) in the belt width direction, and is located so as to overlap a part of the opening portions 80 of the other opening portion row 81 when viewed in the A direction. In this case, even when ink is ejected from the nozzles (ink ejection ports 18) at any position in the width direction of the recording heads 17*a* to 17*c*, ink can be ejected from the nozzles and flushed by passing through the opening portions 80 at any position in the belt width direction of the first conveyor belt 8. Therefore, clogging of the nozzles can be reduced or prevented for the nozzles at all positions in the width direction.

Furthermore, in the first conveyor belt 8, the plurality of opening portions 80 of the opening portion rows 81 are located at equal intervals in the belt width direction. With this configuration, by arranging the plurality of opening portion rows 81 so as to be shifted in the belt width direction, it becomes easy to partially overlap the opening portions 80 of the adjacent opening portion rows 81 when viewed in the A direction. Therefore, it becomes easy to manufacture the first conveyor belt 8 having such a configuration.

Moreover, in the present embodiment, the first conveyor belt 8 has six opening portion groups 82 in the A direction in one cycle. In this case, for the four classes classified according to the size of the paper P, it is possible to generate a pattern in the A direction of the opening portion groups 82 without lowering the productivity. Note that the first conveyor belt 8 may have seven or more opening portion groups 82 in the A direction in one cycle. In this case, it is possible to generate a pattern in the A direction of the opening portion groups 82 that does not reduce the productivity for five or more classes classified according to the size of the paper P.

(3-3. Other Configuration Example of the First Conveyor Belt)

Figure 13:
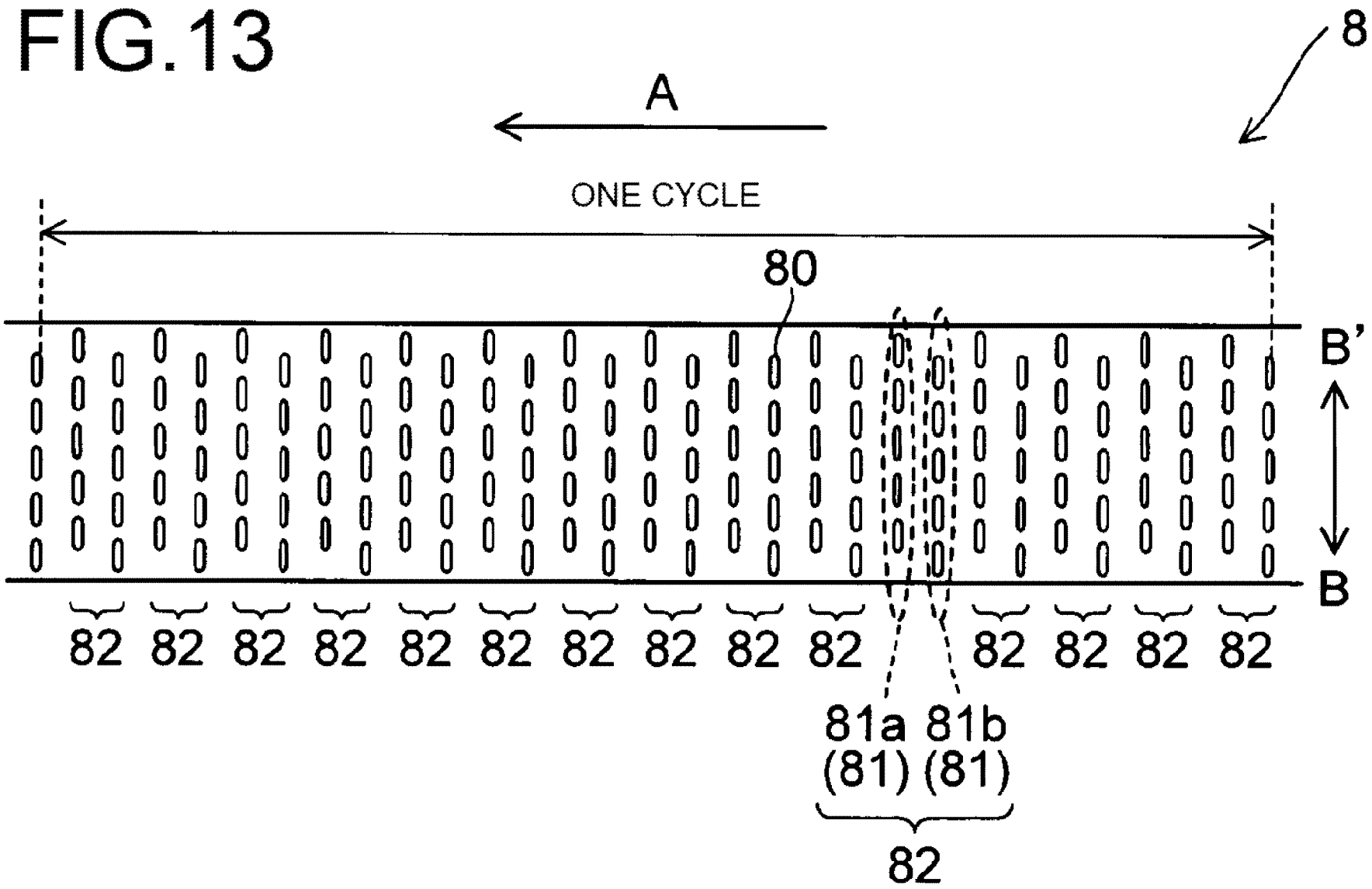
FIG. 13 is a plan view illustrating another configuration example of the first conveyor belt.

FIG. 13 is a plan view illustrating another configuration example of the first conveyor belt 8. The first conveyor belt 8 may have a configuration in which the opening portion groups 82 described above are located at equal intervals in the conveying direction of the first conveyor belt 8, or in other words, the A direction. In this case, two opening portion groups 82 adjacent to each other in the A direction are both arranged at intervals shorter than the length of the paper P in the A direction when the smallest printable size of the paper P is placed on the first conveyor belt 8. In addition, in the configuration of FIG. 13, the opening portions 80 that constitute the opening portion groups 82 also serve as suction holes 8*a* in the configuration of FIG. 8. Note that the point that the opening portion groups 82 have a plurality of opening portion rows 81, and the point that one opening portion row 81 has a plurality of opening portions 80 arranged at equal intervals in the BB' direction, are the same as the first conveyor belt 8 described in FIG. 8 and the like.

Figure 14:
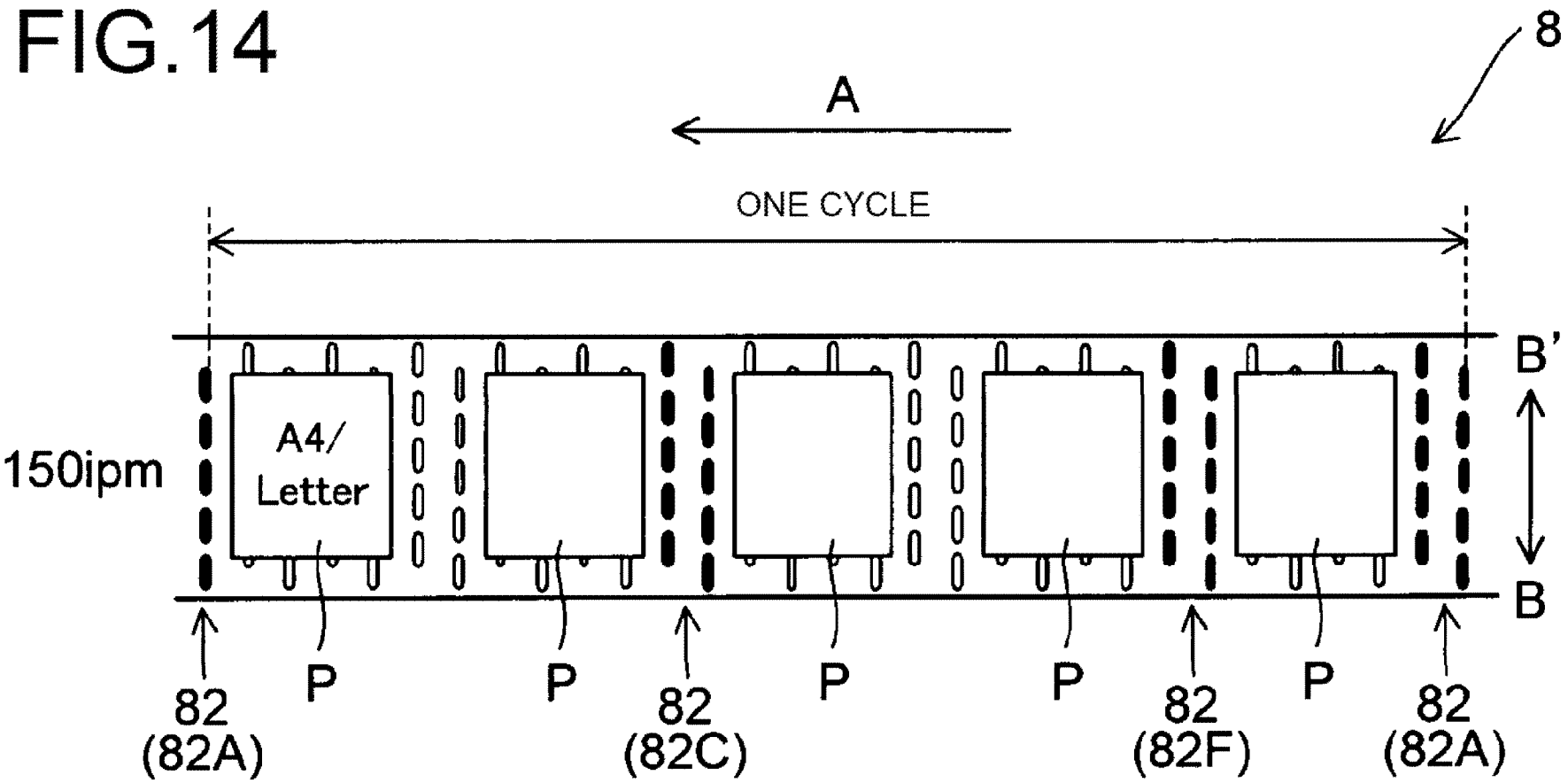
FIG. 14 is an explanatory diagram schematically showing an example of the pattern when the first conveyor belt of FIG. 13 is used and paper arranged on the first conveyor belt according to the pattern.
Figure 15:
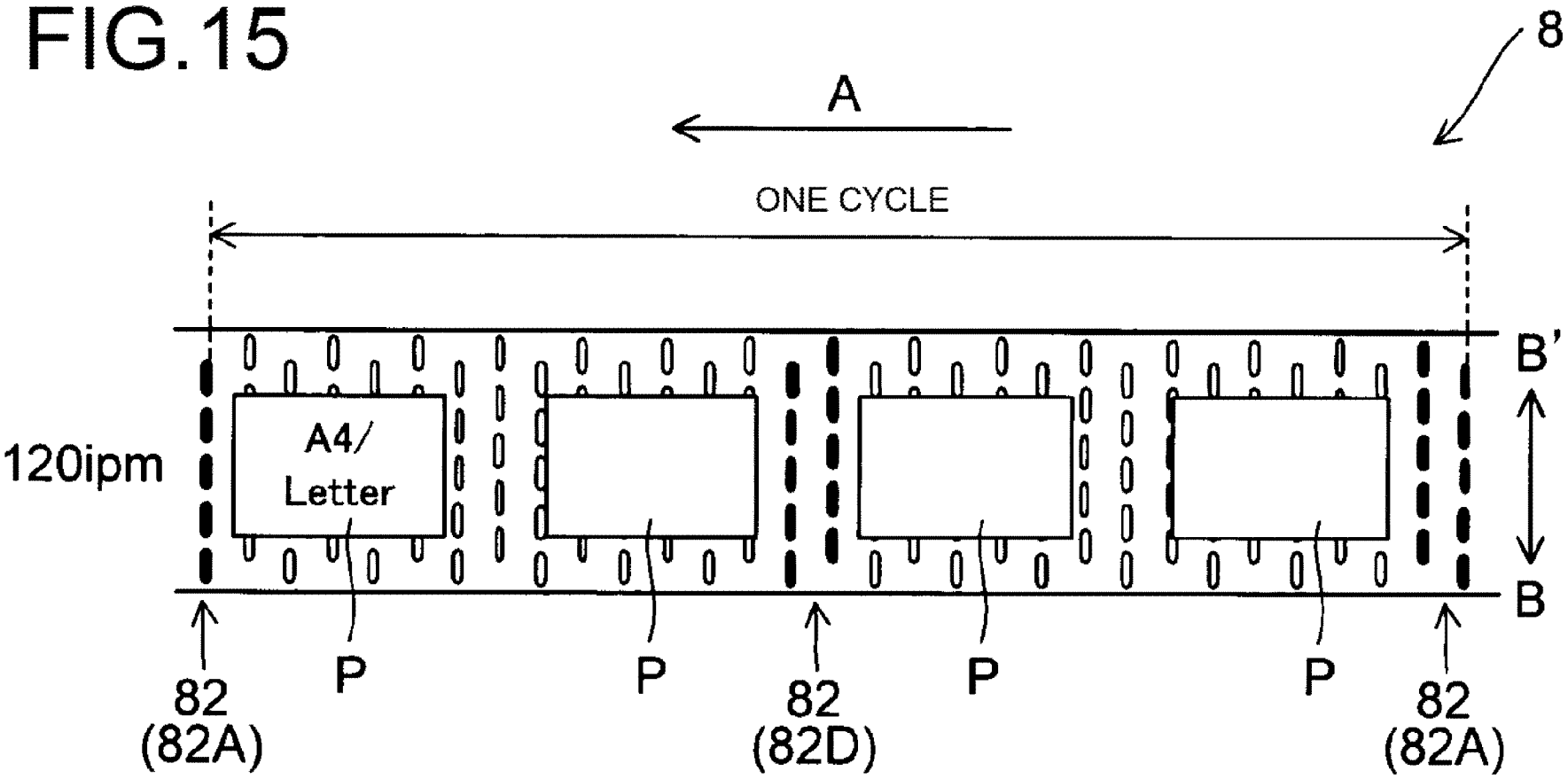
FIG. 15 is an explanatory diagram schematically illustrating another example of the pattern and paper arranged on the first conveyor belt according to the pattern.
Figure 16:
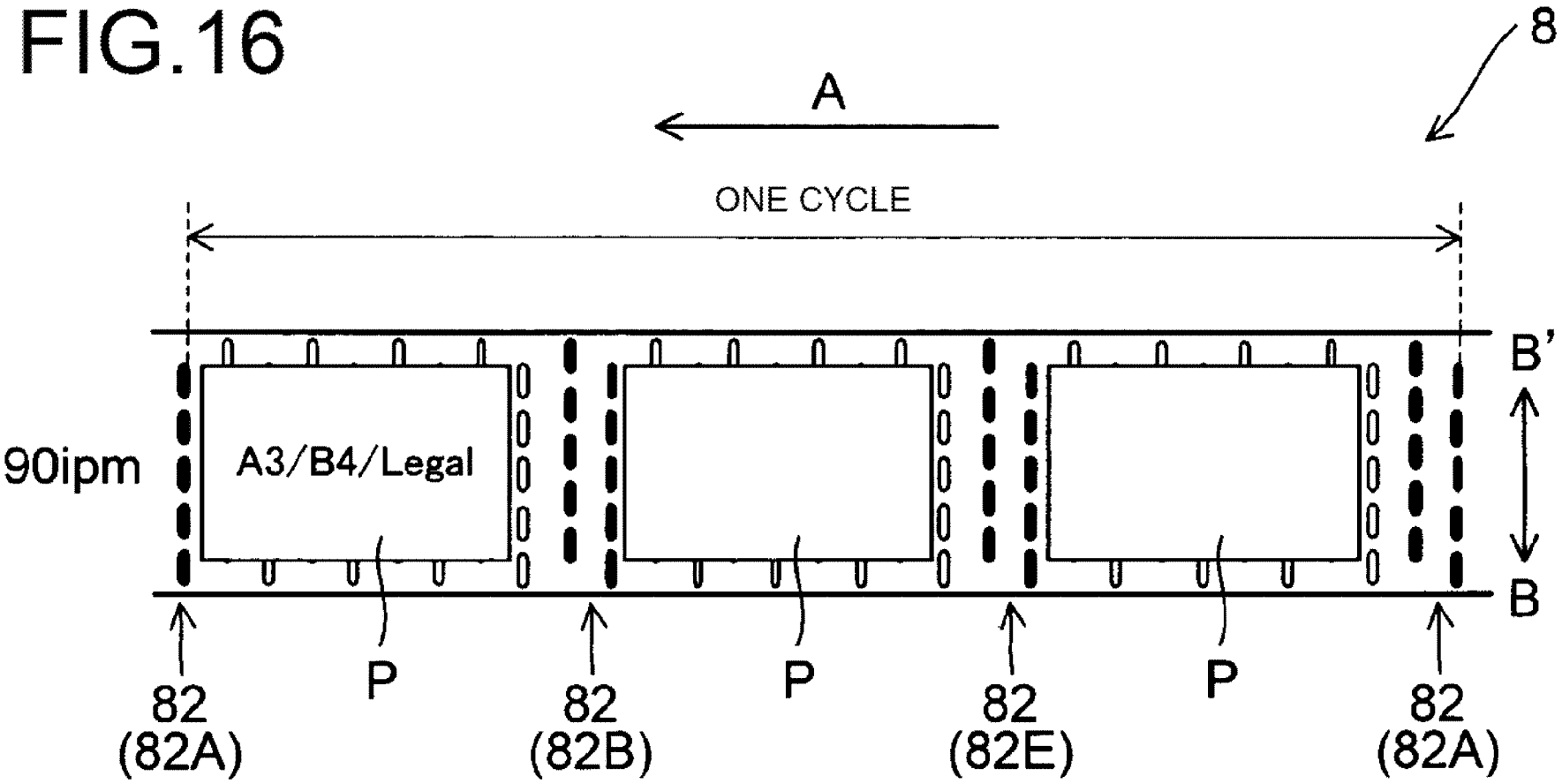
FIG. 16 is an explanatory diagram schematically illustrating yet another example of the pattern and paper arranged on the first conveyor belt according to the pattern.
Figure 17:
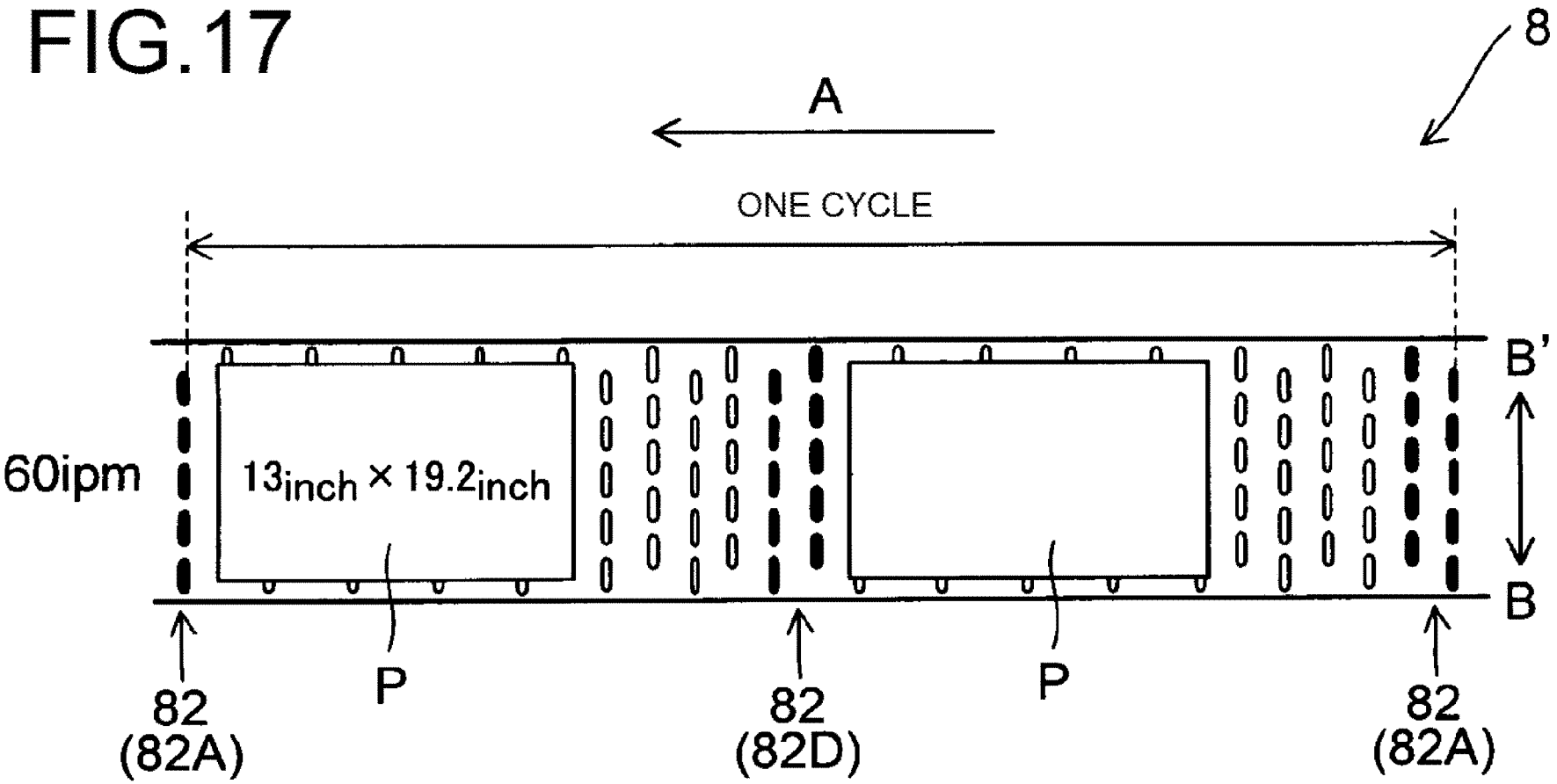
FIG. 17 is an explanatory diagram schematically illustrating yet another example of the pattern and paper arranged on the first conveyor belt according to the pattern.

Even in a case where the first conveyor belt 8 illustrated in FIG. 13 is used, the control unit 110, as in the case of using the first conveyor belt 8 illustrated in FIG. 8, determines a pattern of the plurality of opening portion groups 82 in the A direction that will be used at the time of flushing according to the size of the paper P to be used. For example, in a case where the paper P to be used is A4 size (horizontal placement) or letter size (horizontal placement), the control unit 110 selects the pattern of the opening portion groups 82 illustrated in FIG. 14. In a case where the paper P to be used is A4 size (vertical placement) or letter size (vertical placement), the control unit 110 selects the pattern of the opening portion groups 82 illustrated in FIG. 15. In a case where the paper P to be used is A3 size, B4 size, or legal size (each vertically placed), the control unit 110 selects the pattern of the opening portion groups 82 illustrated in FIG. 16. In a case where the paper P to be used has a size of 13 inches×19.2 inches, the control unit 110 selects the pattern of the opening portion groups 82 illustrated in FIG. 17. Note that, in FIGS. 14 to 17, for convenience, the opening portion groups 82 in positions corresponding to the opening portion groups 82A to 82F in FIG. 8 are illustrated as the opening portion groups 82A to 82F.

Then, the control unit 110, by the running of the first conveyor belt 8, causes the recording heads 17*a* to 17*c* to execute flushing at the timing when the opening portion groups 82 positioned in the determined pattern face the recording heads 17*a* to 17*c*.

In addition, the control unit 110 causes the registration roller pair 13 to supply the paper P to the position illustrated in FIGS. 14 to 17 on the first conveyor belt 8 (between the plurality of opening portion groups 82 arranged in the direction A in the above pattern). In other words, the control unit 110 determines the supply timing for supplying the paper P to the first conveyor belt 8 according to the size of the paper P so that during one cycle of the first conveyor belt 8 for conveying a plurality of sheets of paper P of the minimum size, an integer number of sheets (preferably a plurality of sheets) of paper P of another size are conveyed. Then, the control unit 110 causes the paper P to be supplied to the first conveyor belt 8.

As described above, even when the first conveyor belt 8 illustrated in FIG. 13 is used, the control unit 110, by performing the same control as when the first conveyor belt 8 illustrated in FIG. 8 is used, it is possible to obtain a similar effect. This control is flushing control and a paper P supply control. In other words, the following effects can be obtained, and it is possible to reduce nozzle clogging due to insufficient flushing regardless of the size of the paper P used. Flushing control over the entire cycle of the first conveyor belt 8 becomes easy. While maintaining at least the productivity of the minimum size paper P, the productivity of other sizes of paper P may also be maintained. Staining of the paper P caused by the flushing ink can be reduced, or the like.

In particular, a configuration in which the opening portion groups 82 are located at equal intervals in the A direction of the first conveyor belt 8 can be easily achieved by forming holes in the first conveyor belt 8 at constant intervals in the A direction. Therefore, manufacturing the first conveyor belt 8 is simplified, and the manufacturing cost thereof can be reduced.

In addition, in a configuration in which the opening portions 80 of the first conveyor belt 8 also have the function of the suction holes 8*a* illustrated in FIG. 8, the opening area of the opening portions 80 is equal to the opening area of the suction holes 8*a* and only one type of hole size needs to be formed in the first conveyor belt 8. From this aspect as well, manufacturing of the first conveyor belt 8 is easier than in the case of the configuration of FIG. 8 in which two different types of hole sizes are formed.

Note that in a configuration in which the paper P is conveyed by the first conveyor belt 8 by the negative pressure suction method, in order to obtain the effect of reducing clogging or the like of the nozzles due to insufficient flushing while avoiding the decrease in productivity, the first conveyor belt 8 may have the configuration illustrated in FIG. 8 or the configuration illustrated in FIG. 13. Therefore, in summarizing the configurations of FIGS. 8 and 13, it can be said that in the first conveyor belt 8, the size of the opening portions 80 may be equal to or larger than the size of the suction holes 8*a*.

Note that in the first conveyor belt 8 configured as illustrated in FIG. 13, innumerable opening portions 80 for flushing are formed over the entire surface of the belt. Therefore, the paper P can be packed and conveyed in the A direction on the first conveyor belt 8, and by performing flushing using the opening portions 80 at a position not overlapped by the paper P, it is possible to significantly improve productivity. However, when the paper P is conveyed in such a manner, the opening portions 80, which become stained due to the passage of ink during flushing, and the paper P to be conveyed are likely to overlap with each other in each cycle of the first conveyor belt 8, making it easier for the paper P to become stained.

Even with a configuration using the first conveyor belt 8 in FIG. 13, as described above, the pattern of the opening portion groups 82 used at the time of flushing is determined according to the size of the paper P, and flushing is performed using the opening portion groups 82 positioned in the determined pattern. As a result, together with being able to perform flushing using the same opening portion groups 82 in each cycle, the paper P can be arranged and conveyed at positions shifted from the opening portion groups 82 used for flushing. Accordingly, it is possible to reduce stains on the paper P when the paper P is conveyed and printed over a plurality of cycles while at the same time maintain productivity. In this respect, the flushing control and the paper P supply control described in the present embodiment are effective even when the first conveyor belt 8 having the configuration of FIG. 13 is used.

Note that in a case where the paper P is conveyed by the first conveyor belt 8 illustrated in FIG. 13, the pattern of the opening portion groups 82 used during flushing may be a different pattern than the pattern in a case where the first conveyor belt 8 illustrated in FIG. 8 is used. For example, the flushing may be performed on the opening portion groups located between the paper P and the paper P conveyed at the positions illustrated in FIGS. 14 to 17.

In the description above, a case is explained in which the paper P is sucked to the first conveyor belt 8 by negative pressure and conveyed, however, the first conveyor belt 8 may be electrically charged and the paper P may be electrostatically sucked to the first conveyor belt 8 and conveyed (electrostatic attraction method). Even in this case, the same effect as that of the present embodiment may be obtained by performing flushing control and supply control of the paper P to the first conveyor belt 8 in a manner similar to the present embodiment.

[4. Flushing Control According to Nozzle Usage]

(4-1. Flushing Control Based on Integrated Printing Rate)

In the present embodiment, while the paper P is conveyed by the first conveyor belt 8 having opening portion groups 82, the control unit 110 forms an image on the paper P by driving the recording heads 17*a* to 17*c* based on image data. In such a configuration, the degree of drying of the ink in each ink ejection port 18 of the recording heads 17*a* to 17*c* differs depending on the usage status of each ink ejection port 18 at the time of image formation, or in other words is the ink ejection status from each ink ejection port 18. Moreover, the ink ejection status from each ink ejection port 18 differs depending on what kind of image is formed on the paper P.

Therefore, in the present embodiment, the amount of ink ejected from each ink ejection port 18 during flushing is controlled as follows.

Figure 18:
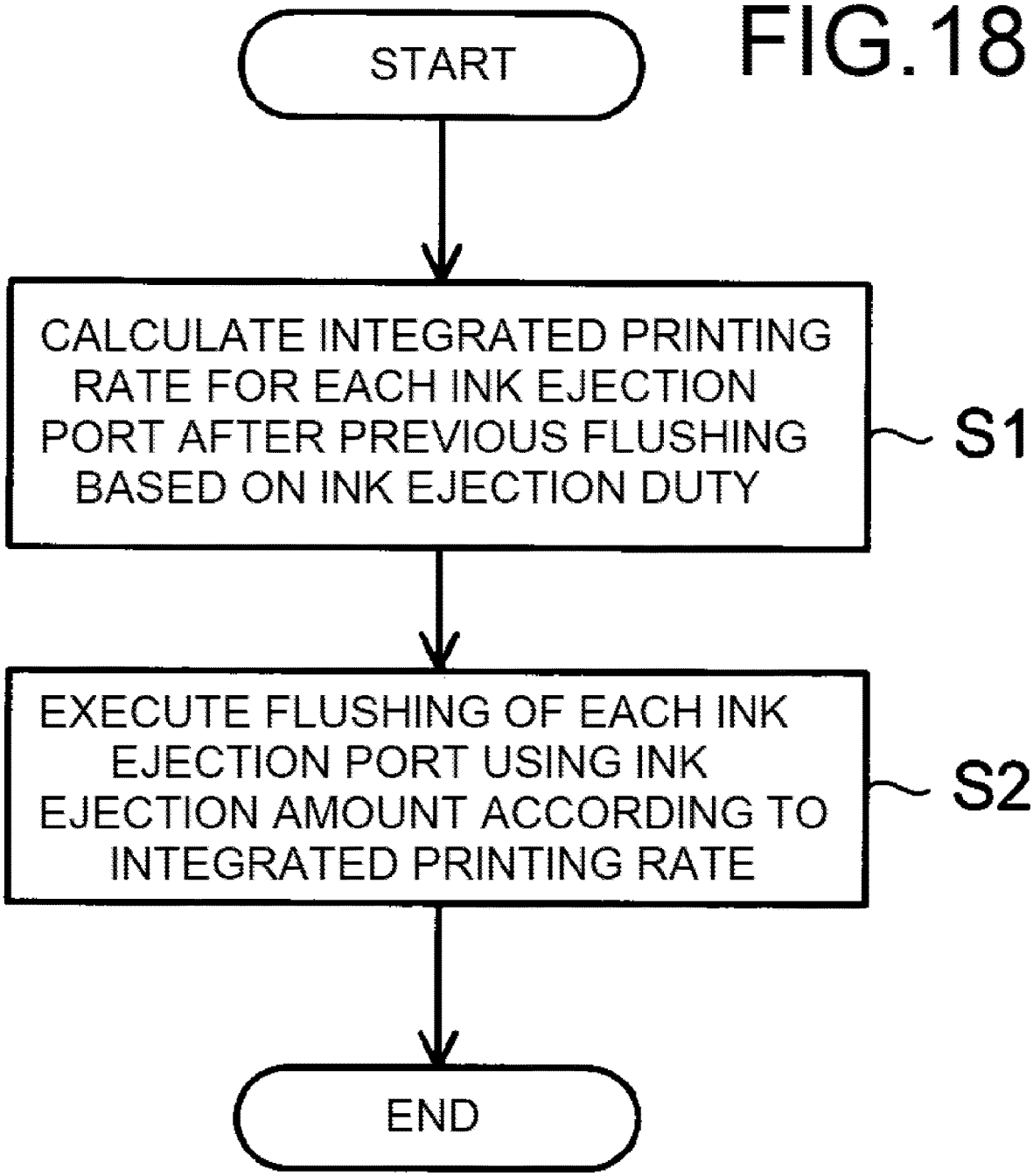
FIG. 18 is a flowchart illustrating an example of flushing control according to the usage status of each ink ejection port of the recording unit.

FIG. 18 is a flowchart illustrating an example of flushing control according to the usage status of each ink ejection port 18. The control unit 110, based on the ink ejection duty for each ink ejection port 18, calculates the integrated printing rate for each ink ejection port 18 since performing the previous flushing (S1).

Here, the integrated printing rate can be calculated based on the ink discharge duty for each ink ejection port 18 when the recording heads 17*a* to 17*c* eject ink based on the image data to form an image on the paper P after the previous flushing has been performed. The number of sheets of paper P may be one or more. The ink ejection duty is the ratio of the ink ejection period to the ink non-ejection period. For example, in a case where the ratio of the ink ejection period to the ink non-ejection period at an arbitrary ink ejection port 18 is 1:1, the integrated printing rate is ½, or in other words, 50%.

Note that the ink ejection duty is determined based on the image data of the image formed on at least one sheet of paper P. For example, the ratio of ink ejection pixels to non-ink ejection pixels included in a plurality of pixels forming one line along the paper conveying direction of the image formed on the paper P corresponds to the ink ejection duty of the ink ejection ports 18 that eject ink to the line above. The ink ejection pixels are image data corresponding to ink ejection ON. The non-ink ejection pixels are image data corresponding to ink ejection OFF. At this time, one pixel of an image may correspond to one ink ejection port 18 or may correspond to a plurality of ink ejection ports 18.

Next, the control unit 110, based on the integrated printing rate for each ink ejection port 18 calculated in S1, controls the ink ejection amount in the next flushing for each ink ejection port 18 and causes flushing to be executed in the recording heads 17*a* to 17*c* (S2).

FIG. 19 illustrates an example of setting the flushing amount in each ink ejection port 18, or in other words, the ink ejection amount at the time of flushing. For example, the flushing amount for each ink ejection port 18 at the time of the previous flushing such as during the flushing using the opening portion group 82A in FIG. 9 is set to A1 (pl). Then, it is presumed that the integrated printing rate in the first ink ejection port 18 from the previous flushing is 10%. It is then presumed that the integrated printing rate in the second ink ejection port 18 is 50%, . . . , and the integrated printing rate in the Nth ink ejection port 18 is 80%. In this case, in the next flushing such as flushing using the opening portion group 82C in FIG. 9, the control unit 110 sets the ink ejection amount from the second ink ejection port 18 to the same A1 (pl) as in the previous flushing. Then, the ink ejection amount from the first ink ejection port 18 is set to A2 (pl), which is larger than A1. This is because the integrated printing rate is relatively small based on the integrated printing rate of the second ink ejection port 18. Then, the ink ejection amount from the Nth ink ejection port 18 is set to A3 (pl), which is less than A1. This is because the integrated printing rate is relatively large based on the integrated printing rate of the second ink ejection port 18. After this, the control unit 110 causes flushing to be executed in the recording heads 17*a* to 17*c*. Note that the ink ejection amount can be changed for each ink ejection port 18. This becomes possible by changing the number of ink droplets ejected per unit time or the ink ejection amount in one ejection.

In this way, the control unit 110, based on the integrated printing rate for each ink ejection port 18 since performing the previous flushing, controls the ink ejection amount for each ink ejection port 18 in the next flushing. As a result, the ink ejection amount in the next flushing can be appropriately controlled for each ink ejection port 18 in consideration of the actual ink ejection situation for each ink ejection port 18 when image formation is performed after the previous flushing. Ads a result, it is possible to reduce excessive or insufficient flushing in the plurality of ink ejection ports 18. In other words, control is performed to reduce the ink ejection amount at the next flushing for the Nth ink ejection port 18 where the ink ejection amount at the time of image formation is large and drying of ink does not proceed so much. As a result, it is possible to reduce situations in which the ink is ejected more than necessary and ink is wastefully consumed (excessive flushing). On the other hand, the control unit 110 performs control to increase the ink ejection amount during the next flushing for the first ink ejection port 18 in which there is a small ink ejection amount during image formation and in which ink tends to dry easily. As a result, it is possible to reduce situations in which nozzle clogging (insufficient flushing) occurs due to ink drying due to an insufficient ink ejection amount during flushing.

Moreover, the control unit 110 calculates the integrated printing rate described above for each ink ejection port 18 (S1). This is performed based on the ink ejection duty of each ink ejection port 18 after the recording heads 17*a* to 17*c* have been flushed during the previous flushing and the recording heads 17*a* to 17*c* have been controlled to form an image on the paper P. As a result, the control unit 110 reliably controls the ink ejection amount in the next flushing for each ink ejection port 18 based on the integrated printing rate that is calculated for each ink ejection port 18. Then, excessive or insufficient flushing in the plurality of ink ejection ports 18 can be reliably reduced.

(4-2. Flushing Control According to the Usage Environment)

In addition to flushing control that is based on the integrated printing rate described above, the control unit 110 may also perform flushing control according to the usage environment of the printer 100. In other words, the control unit 110 may change the amount of ink ejected from each ink ejection port 18 in the next flushing according to the usage environment of the printer 100. Here, the temperature of the environment is considered as an example of the usage environment. In this case, the control unit 110 may perform control to change the ink ejection amount during flushing based on the detection result of a first temperature sensor 41 (see FIG. 4), or in other words, the detected ambient temperature of the printer 100.

FIG. 20 illustrates an example of setting the flushing amount according to the usage environment in the first ink ejection port 18. For example, in a case where based on the detection result of the first temperature sensor 41 it is determined that the ambient temperature of the printer 100 is low (less than a first threshold value), the control unit 110 keeps the ink ejection amount from the first ink ejection port 18 during flushing as is at A2 (pl) illustrated in FIG. 19. In a case where the ambient temperature of the printer 100 is determined to be high (greater than or equal to the first threshold value), the control unit 110 sets the ink ejection amount from the first ink ejection port 18 during flushing to A21 (pl), which is less than A2. The control unit 110 causes flushing to be executed in this way. Note that by performing the same control as described above for the second to Nth ink ejection ports 18 as well, the flushing amount can be changed according to the environmental temperature based on to the ink ejection amount at the time of the next flushing illustrated in FIG. 19.

When the environmental temperature is low, the viscosity of the ink in the vicinity of the ink ejection port 18 increases, so it becomes easy for clogging of the ink ejection port 18 to occur. On the other hand, when the environmental is high, the increase in viscosity of the ink near the ink ejection port 18 is suppressed, so it becomes more difficult for clogging of the ink ejection port 18 to occur. By changing ink ejection amount during flushing according to the temperature of the environment as described above, the occurrence of clogging of the ink ejection ports 18 due to the decrease in the environmental temperature is reduced, and in a case where the environmental temperature is high, the ink ejection amount during flushing can be reduced to reduce the amount of ink consumed.

In other words, by controlling the flushing amount according to the usage environment, it is possible to perform flushing with an appropriate ink ejection amount according to the usage environment and reduce excessive or insufficient flushing for each ink ejection port 18. In particular, by taking into consideration the temperature of the environment as the usage environment, flushing can be appropriately performed with an appropriate ink ejection amount according to the temperature of the environment.

In addition, the control unit 110 changes the ink ejection amount during flushing based on the detection result of the first temperature sensor 41, so the control described above for changing the ink ejection amount during flushing according to the temperature of the environment may be reliably performed.

(4-3. Flushing Control According to the Temperature of the Recording Heads)

The control unit 110 may also further perform flushing control according to the temperature of the recording heads 17*a* to 17*c*. In other words, the control unit 110 may change the ink ejection amount from each ink ejection port 18 in the next flushing according to the temperature of the recording heads 17*a* to 17*c*. For example, the control unit 110 may perform control to change the ink ejection amount during flushing based on the detection result of a second temperature sensor 42 (see FIG. 4), or in other words, the detected temperature of the recording heads 17*a* to 17*c*.

FIG. 21 illustrates an example of setting the flushing amount in the first ink ejection port 18 according to the temperature of the recording heads 17*a* to 17*c*. For example, control by the control unit 110 in a case where the temperature of the recording heads 17*a* to 17*c* is low (less than the second threshold value) based on the detection result of the second temperature sensor 42. In this case, the control unit 110 keeps the ink ejection amount from the first ink ejection port 18 during flushing as is at A2 (pl) illustrated in FIG. 19. Moreover, a case will be described in which the temperature of the recording heads 17*a* to 17*c* is high (equal to or greater than the second threshold value). In this case, flushing is executed with the ink ejection amount from the first ink ejection port 18 during flushing set to A22 (pl), which is smaller than A2. Note that by performing the same control as described above for the second to Nth ink ejection ports 18 as well, the flushing amount can be changed according to the temperature of the recording heads 17*a* to 17*c* based on to the ink ejection amount at the time of the next flushing illustrated in FIG. 19.

When the temperature of the recording heads 17*a* to 17*c* is low (for example, immediately after the printer 100 is started), the viscosity of the ink inside the recording heads 17*a* to 17*c* increases, so it becomes easy for clogging of the ink ejection ports to occur. On the other hand, when the temperature of the recording heads 17*a* to 17*c* is high (for example, when the printer 100 is continuously used), the increase in the viscosity of the ink inside the recording heads 17*a* to 17*c* is suppressed, so it becomes difficult for clogging of the ink ejection ports 18 to occur.

As described above, the control unit 110 changes the ink ejection amount at the time of flushing according to the temperature of the recording heads 17*a* to 17*c*. As a result, the occurrence of clogging of the ink ejection ports 18 due to the decrease in the temperature of the recording heads 17*a* to 17*c* is reduced, while in a case where the temperature of the recording heads 17*a* to 17*c* is high, it is possible to reduce the ink ejection amount during flushing and suppress in consumption. In other words, it is possible to reduce excessive or insufficient flushing for each ink ejection port 18 by performing flushing with an appropriate ink ejection amount according to the temperature of the recording heads 17*a* to 17*c*.

In addition, the control unit 110 changes the ink ejection amount during flushing based on the detection result of the second temperature sensor 42, so the control described above for changing the ink ejection amount during flushing according to the temperature of the recording heads 17*a* to 17*c* may be reliably performed.

(4-4. Flushing Control According to the Type of Ink)

The control unit 110 may further perform flushing control according to the type of ink used. In other words, the control unit 110 may change the ink ejection amount from each ink ejection port 18 in the next flushing according to the type of ink used. Here, as the type of ink used, for example, the color of the ink used is considered. Note that the color of the ink can be recognized by the control unit 110 based on the image data of the image recorded on the paper P.

FIG. 22 illustrates an example of setting the flushing amount according to the type (color) of the ink in an arbitrary ink ejection port 18 (here, the first ink ejection port 18 is used as an example) of each of the recording heads 17*a* to 17*c* of the line heads 11Y, 11M, 11C, and 11K. For example, for the first ink ejection port 18 of the line head 11Y for ejecting Y ink, the control unit 110 keeps the ink ejection amount from the first ink ejection port 18 during flushing as is at A2 (pl) illustrated in FIG. 19. Moreover, for the first ink ejection port 18 of the line head 11M that ejects M ink, the control unit 110 sets the ink ejection amount from the first ink ejection port 18 at the time of flushing to A23 (pl). Additionally, for the first ink ejection port 18 of the line head 11C that ejects C ink, the control unit 110 sets the ink ejection amount from the first ink ejection port 18 at the time of flushing to A24 (pl). Furthermore, for the first ink ejection port 18 of the line head 11K that ejects K ink, the control unit 110 sets the ink ejection amount from the first ink ejection port 18 at the time of flushing to A25 (pl). The control unit 110 then causes flushing to be executed. Note that A23, A24, and A25 have different ejection amounts from A2, and the magnitude relationship of the ejection amounts may be arbitrarily set. Note that for the second to Nth ink ejection ports 18 of the recording heads 17*a* to 17*c* of the line heads 11Y to 11K as well, the control unit 110 in the same manner as described above may change the flushing amount according to the color of ink based on the ink ejection amount during the next flushing illustrated in FIG. 19.

The viscosity of the ink varies depending on the type of ink. Therefore, by changing the ink ejection amount at the time of flushing according to the type of ink as described above, the control unit 110 is able to performed appropriate flushing according to the type of ink and reduce excessive or insufficient flushing. In particular, by changing the ink ejection amount at the time of flushing according to the color of ink, the control unit 110 is able to perform appropriate flushing according to the color of the ink and reliably reduce excessive or insufficient flushing.

Note that the type of ink is not limited to the color of the ink. For example, there are inks having the same ink color but different ratios of contained components and ink dyes or pigment concentrations. In this case, the control unit 110 may also perform control to change the ink ejection amount at the time of flushing according to the above-mentioned ratios or the above concentrations.

(4-5. Flushing Control According to Paper Size)

The control unit 110 may further perform flushing control according to the size of the paper P to be used. In other words, the control unit 110 may change the ink ejection amount from each ink ejection port 18 in the next flushing according to the size of the paper used. Note that the size of the paper P to be used can be recognized by the control unit 110 based on the information stored in the storage unit 28 (size information of the paper P inputted by the operation panel 27); however, the size of the paper P may also be recognized based on the ink ejection duty at the time of image formation described above.

FIG. 23 illustrates an example of setting the flushing amount in the first ink ejection port 18 according to size of the paper. For example, in a case where the paper P to be used is A4 size (horizontal placement) or letter size (horizontal placement), the control unit 110 keeps the ink ejection amount from the first ink ejection port 18 at the time of flushing as is at A2 (pl) illustrated in FIG. 19. Moreover, in a case where the paper P to be used is A4 size (vertical placement) or letter size (vertical placement), the control unit 110 sets the ink ejection amount from the first ink ejection port 18 at the time of flushing to A26 (pl) that is larger than A2. In addition, in a case where the paper P to be used is A3 size, B4 size or legal size (all vertically placed), the control unit 110 sets the ink ejection amount from the first ink ejection port 18 at the time of flushing to A2.

Furthermore, in a case where the paper P to be used has a size of 13 inches×19.2 inches, the control unit 110 sets the ink ejection amount from the first ink ejection port 18 at the time of flushing to A26 (pl) that is larger than A2. The control unit 110 then causes flushing to be executed. Note that for the other ink ejection ports 18 as well, the control unit 110 in the same manner as described above may change the flushing amount according to the size of the paper P to be used based on the ink ejection amount during the next flushing illustrated in FIG. 19.

For example, in a case where the paper P is conveyed using the first conveyor belt 8 illustrated in FIG. 8, the pattern of the opening portion group 82 used for flushing can be determined according to the size of the paper P as described above. As illustrated in FIGS. 9 and 11, in a case where the paper P to be used is A4 size (horizontal placement), letter size (horizontal placement), A3 size, B4 size or legal size (all vertically placed), the opening portion groups 82 used for flushing are located at three locations in one cycle of the first conveyor belt 8. In this case, the number of flushes of the first conveyor belt 8 in one cycle is relatively large, so it is difficult for the viscosity of the ink to increase due to drying. Therefore, it is possible to reduce the occurrence of clogging of the ink ejection port 18 without increasing the ink ejection amount during flushing. On the other hand, as illustrated in FIGS. 10 and 12, in a case where the paper P used is A4 size (vertical placement), letter size (vertical placement), and 13 inches×19.2 inches, the opening portion groups 82 used for flushing are located at two locations in one cycle of the first conveyor belt 8. In this case, the number of flushes in one cycle of the first conveyor belt 8 is relatively few, it tends to become easy for the viscosity of the ink to increase due to drying, and it becomes easy for the ink ejection ports 18 to become clogged.

Therefore, by changing the ink ejection amount at the time of flushing according to the size of the paper P to be used as described above, the number of flushes and the flushing amount (ink ejection amount) corresponding to the size of the paper P are achieved. It is then possible to reduce excessive or insufficient flushing in one cycle of the first conveyor belt 8.

In particular, the control unit 110 recognizes the size of the paper P based on the size information of the paper P stored in the storage unit 28, and changes the ink ejection amount at the time of flushing according to the recognized size. Therefore, flushing control according to the size of the paper P can be reliably achieved, and excessive or insufficient flushing can be reliably reduced.

Note that at least any one of the flushing controls of 4-2 to 4-5 may be combined with the flushing control of 4-1 described above, and it is also possible for all of the flushing controls to be combined.

In the description above, an example of performing inter-paper flushing in which flushing is performed between paper P and paper P that is conveyed by the first conveyor 8 has been described. However, in a case where the flushing amount (ink ejection amount) cannot be sufficiently maintained by inter-paper flushing, in-paper flushing that performs flushing of the paper surface may be further executed. In other words, the control unit 110, in addition to timing when the opening portion groups 82 face the recording heads 17*a* to 17*c*, may also cause flushing of the recording heads 17*a* to 17*c* to be executed at timing when the paper P faces the recording heads 17*a* to 17*c*. In this case, it is possible to maintain the required flushing amount by compensating for an insufficient flushing amount by inter-paper flushing with the in-paper flushing, so the ink ejection performance at each ink ejection port 18 may be sufficiently maintained. Note that in-paper flushing affects the image quality of the image formed on the paper P, so it is desirable that in-paper flushing be performed in a case where securing the flushing amount is prioritized over the image quality.

In the description above, an example is described in which a color printer that records a color image using four colors of ink is used as the inkjet recording apparatus. However, the control described in the present embodiment may be applied even in a case where a monochrome printer that records a monochrome image using black ink is used.

Incidentally, the usage status of each nozzle of the recording head differs for each nozzle depending on what kind of image is formed on the recording medium by ink ejection. Therefore, the degree of drying of the ink in each nozzle after the completion of image formation on the recording medium also differs between each of the nozzles. A case in which flushing is performed using an opening portion located between recording medium and recording medium continuously conveyed on a conveyor belt will be considered. At this time, when performing flushing using the same ink ejection amount in each of the nozzles of the recording head, excessive or insufficient flushing of the plurality of nozzles may occur in some cases due to the difference in usage status of each nozzle during image formation before flushing described above Here, in a case of excessive flushing, the ink is wastefully consumed by ejecting more in than necessary. On the other hand, in a case of insufficient flushing, the ink ejection amount is insufficient, so it becomes difficult to reduce clogging of the nozzles due to ink drying. Therefore, it is desirable to perform flushing with an appropriate ink ejection amount for each nozzle in consideration of the actual usage state (ink ejection state) of each nozzle at the time of image formation. However, such flushing is not considered at all in typical techniques.

With configuration described above, the ink ejection amount in the subsequent flushing may be appropriately controlled for each nozzle based on the actual ink ejection state of each nozzle of the recording head at the time of image formation. Accordingly, it is possible to reduce excessive or insufficient flushing in each nozzle of the recording head.

The present disclosure may be used in an inkjet recording apparatus that ejects ink onto a storage medium and records an image.

What is claimed is:

1. An inkjet recording apparatus comprising:

a recording head having a plurality of nozzles that eject ink; and an endless conveyor belt that conveys a recording medium to a position facing the recording head; and a control unit that causes the recording head to execute flushing for ejecting the ink at a timing different from a timing that contributes to image formation on the recording medium; wherein the conveyor belt has opening portions for allowing the ink ejected from each nozzle of the recording head at the time of the flushing to pass;

the control unit controls an ink ejection amount in a next flushing for each of the nozzles based on an integrated printing rate for each of the nozzles after the recording head performs a previous flushing;

the conveyor belt has a plurality of opening portion groups in a conveying direction of the recording medium, in which the opening portions are arranged in a belt width direction perpendicular to a conveying direction of the recording medium;

the inkjet recording apparatus further comprises a recording medium supply unit that supplies the recording medium to the conveyor belt; and the control unit determines a supply timing for supplying the recording medium to the conveyor belt according to the size of the recording medium so that an integer number of recording media of other sizes is conveyed during one cycle of the conveyor belt that conveys a plurality of recording media of a smallest size, and causes the recording media to be supplied from the recording medium supply unit to the conveyor belt at the determined supply timing.

2. The inkjet recording apparatus according to claim 1, wherein the control unit calculates the integrated printing rate for each of the nozzles based on an ink ejection duty for each of the nozzles when an image is formed on the recording medium by controlling the recording head after the recording head performs a previous flushing.

3. The inkjet recording apparatus according to claim 1, wherein the control unit changes the ink ejection amount in the flushing according to a usage environment.

4. The inkjet recording apparatus according to claim 3, wherein the usage environment includes a temperature of the environment.

5. The inkjet recording apparatus according to claim 4, further comprising a first temperature sensor that detects the ambient temperature; wherein the control unit changes the ink ejection amount based on a detection result of the first temperature sensor.

6. The inkjet recording apparatus according to claim 1, wherein the control unit changes the ink ejection amount at the time of the flushing according to a temperature of the recording head.

7. The inkjet recording apparatus according to claim 6, further comprising a second temperature sensor that detects the temperature of the recording head; wherein the control unit changes the ink ejection amount based on a detection result of the second temperature sensor.

8. The inkjet recording apparatus according to claim 1, wherein the control unit changes the ink ejection amount at the time of the flushing according to a type of the ink.

9. The inkjet recording apparatus according to claim 8, wherein the type of ink includes a color of the ink recognized based on image data of an image recorded on the recording medium.

10. The inkjet recording apparatus according to claim 1, wherein the control unit changes the ink ejection amount at the time of the flushing according to a size of the recording medium.

11. The inkjet recording apparatus according to claim 10, further comprising a storage unit that stores information about the size of the recording medium conveyed by the conveyor belt, wherein the control unit recognizes the size of the recording medium based on the information stored in the storage unit, and changes the ink ejection amount according to the recognized size.

12. The inkjet recording apparatus according to claim 1, wherein the conveyor belt has a plurality of opening portion groups in a conveying direction of the recording medium, in which the opening portions are arranged in a belt width direction perpendicular to a conveying direction of the recording medium; and the control unit, determines a pattern in one cycle of the conveyor belt for arranging the opening portion groups used at the time of flushing in the conveying direction according to the size of the recording medium, and causes the recording head to perform the flushing at a timing when the opening portion groups located in the pattern face the recording head due to the running of the conveyor belt.

13. The inkjet recording apparatus according to claim 12, wherein the opening portion groups are located at equal intervals in the conveying direction of the conveyor belt.

14. The inkjet recording apparatus according to claim 12, wherein the control unit, in addition to timing when the opening portion groups face the recording heads, causes flushing of the recording head to be executed at timing when the recording medium faces the recording heads.

15. An inkjet recording apparatus comprising:

a recording head having a plurality of nozzles that eject ink;

an endless conveyor belt that conveys a recording medium to a position facing the recording head; and a control unit that causes the recording head to execute flushing for ejecting the ink at a timing different from a timing that contributes to image formation on the recording medium; wherein the conveyor belt has opening portions for allowing the ink ejected from each nozzle of the recording head at the time of the flushing to pass;

the control unit controls an ink ejection amount in a next flushing for each of the nozzles based on an integrated printing rate for each of the nozzles after the recording head performs a previous flushing;

the conveyor belt has a plurality of opening portion groups in a conveying direction of the recording medium, in which the opening portions are arranged in a belt width direction perpendicular to a conveying direction of the recording medium;

the control unit determines a pattern in one cycle of the conveyor belt for arranging the opening portion groups used at the time of flushing in the conveying direction according to the size of the recording medium, and causes the recording head to perform the flushing at a timing when the opening portion groups located in the pattern face the recording head due to the running of the conveyor belt; and the opening portion groups are irregularly located in the conveying direction in one cycle of the conveyor belt such that the interval in the conveying direction, between adjacent opening portion groups of the conveyor belt, is not constant.

* * * * *